US011129484B2

(12) United States Patent
Scott

(10) Patent No.: US 11,129,484 B2
(45) Date of Patent: Sep. 28, 2021

(54) MULTI-POSITIONABLE FOLDING FOOD SHIELD CONFIGURABLE FOR USE IN CAFETERIA, SELF-SERVE AND SELF-SERVE WITH DISPLAY MODES

(71) Applicant: Advance Tabco, Inc., Edgewood, NY (US)

(72) Inventor: Steven Jamie Scott, Rocky Point, NY (US)

(73) Assignee: Advance Tabco, Inc., Edgewood, NY (US)

( * ) Notice: Subject to any disclaimer, the term of this patent is extended or adjusted under 35 U.S.C. 154(b) by 584 days.

(21) Appl. No.: 16/175,009

(22) Filed: Oct. 30, 2018

(65) Prior Publication Data

US 2019/0150640 A1 May 23, 2019

Related U.S. Application Data

(60) Provisional application No. 62/587,811, filed on Nov. 17, 2017.

(51) Int. Cl.
*A47F 10/06* (2006.01)
*E06B 3/48* (2006.01)
(Continued)

(52) U.S. Cl.
CPC ..... *A47F 10/06* (2013.01); *A47F 3/12* (2013.01); *E05D 11/1007* (2013.01);
(Continued)

(58) Field of Classification Search
CPC ..... A47F 3/12; A47F 10/06; A47F 2010/065; E05D 11/1007; E05D 11/1028;
(Continued)

(56) References Cited

U.S. PATENT DOCUMENTS 4,126,081 A * 11/1978 Zdeb ..... B23Q 11/08 408/67
6,588,863 B1 7/2003 Yatchak et al. ..... 312/140.4
(Continued)

*Primary Examiner* — James O Hansen
(74) *Attorney, Agent, or Firm* — Bodner & O'Rourke, LLP; Gerald T. Bodner; Christian P. Bodner

(57) ABSTRACT

A food shield for use in a restaurant or food service institution includes a pair of partially overlapping upper and lower transparent panels, first and second locking assemblies connected to and supporting one lateral side of each of the upper and lower transparent panels, and first and second non-locking assemblies connected to and supporting the opposite lateral side of each of the upper and lower transparent panels. Each of the first locking and non-locking assemblies, which supports the upper transparent panel, is mountable to a respective vertical support post. The food shield is transformable into three different settings. In a cafeteria setting, the upper and lower transparent panels overlap each other to provide a full length barrier in front of food product being displayed. In a self-serve setting, the lower transparent panel is pivoted inwardly such that it resides behind the upper transparent panel. In a self-serve and display setting, the lower transparent panel is adjusted to a horizontal position to create a shelf situated behind the upper transparent panel.

27 Claims, 13 Drawing Sheets

(51) Int. Cl.

| | |
|---|---|
| ***E05D 11/10*** | (2006.01) |
| ***E05D 15/26*** | (2006.01) |
| ***A47F 3/12*** | (2006.01) |
| *E05D 5/02* | (2006.01) |
| *A47F 3/00* | (2006.01) |

(52) U.S. Cl.
CPC ..... *E05D 11/1028* (2013.01); *E05D 11/1078* (2013.01); *E05D 15/262* (2013.01); *E05D 15/264* (2013.01); *E06B 3/48* (2013.01); *A47F 2003/008* (2013.01); *A47F 2010/065* (2013.01); *E05D 5/0246* (2013.01); *E05Y 2800/672* (2013.01); *E05Y 2900/202* (2013.01)

(58) Field of Classification Search
CPC . E05D 11/1078; E05D 15/262; E05D 15/264; E05D 2015/268; E06B 3/48
USPC ..... 312/137, 140.4

See application file for complete search history.

(56) References Cited

U.S. PATENT DOCUMENTS

| | | | | |
|---|---|---|---|---|
| 8,308,249 | B2 * | 11/2012 | Matus, Jr. | A47F 3/12 312/140.4 |
| 8,403,430 | B2 * | 3/2013 | Atkins | A47F 5/005 312/137 |
| 9,010,883 | B2 | 4/2015 | Scott | 312/137 |
| 9,339,131 | B1 * | 5/2016 | Christianson | A47F 3/007 |
| 9,782,022 | B2 * | 10/2017 | Atkins | F16M 11/10 |
| 2002/0043906 | A1 * | 4/2002 | Dewitt | A47F 9/00 312/137 |
| 2002/0096976 | A1 * | 7/2002 | Matus, Jr. | A47F 10/06 312/137 |
| 2003/0047086 | A1 * | 3/2003 | Matus, Jr. | A47F 10/06 99/485 |
| 2006/0175940 | A1 * | 8/2006 | English | A47F 7/0071 312/137 |
| 2007/0236112 | A1 * | 10/2007 | Williman | A47F 10/06 312/140.4 |
| 2010/0045149 | A1 * | 2/2010 | English | A47B 96/062 312/140.4 |
| 2011/0169384 | A1 * | 7/2011 | Padden | A47F 10/06 312/140.4 |

* cited by examiner

MULTI-POSITIONABLE FOLDING FOOD SHIELD CONFIGURABLE FOR USE IN CAFETERIA, SELF-SERVE AND SELF-SERVE WITH DISPLAY MODES

CROSS-REFERENCE TO RELATED APPLICATIONS

This application is related to U.S. Provisional Patent Application Ser. No. 62/587,811, filed on Nov. 17, 2017, and entitled "Multi-Positionable Folding Food Shield Configurable for Use in Cafeteria, Self-Serve and Self-Serve with Display Modes", the disclosure of which is hereby incorporated by reference and on which priority is hereby claimed.

BACKGROUND OF THE INVENTION

Field of the Invention

The present invention generally relates to equipment used in restaurants and other food service institutions where food is displayed, and more particularly relates to a food shield or barrier through which food served by such an institution may be viewed by a customer.

Description of the Prior Art

There are numerous health and safety codes with which restaurants and other food service institutions must comply. One or more of such codes require that food displayed by the food service institution or restaurant be separated from a customer by a barrier. In many self-service food establishments, the food is uncovered when displayed, and an adjustable transparent barrier is provided between the food and the customer, which allows the customer to see the displayed food but does not unduly restrict the customer's access to the food so that he may make his selection. Such barriers are commonly referred to in the food service industry as "sneeze guards", because they aid in preventing contamination of the displayed food by airborne bacteria transmitted by the customer. One would commonly find such food barriers at self-service salad bars or food buffets in a restaurant.

There are a wide variety of food shields or "sneeze guards" used in the food service industry today, and many of these include a transparent panel, such as an acrylic or glass pane, supported by two or more vertical posts on opposite lateral sides of the transparent panel, and connected to the posts by locking mechanisms or assemblies which permit the panel to be adjusted in height on the posts as well as at a desired angle. Two such food shields are disclosed in U.S. Pat. No. 9,010,883, which issued to Steven Jamie Scott, and U.S. Pat. No. 6,588,863, which issued to Yatchak, et al.

Some conventional food shields are capable of being configured for use in a cafeteria-style restaurant, where the food products are visible to a patron through the transparent panel but inaccessible to the patron, i.e., where a restaurant employee provides to the patron the food product the patron selected, and also for use in a self-serve restaurant, such as is commonly used with a salad bar, where the patron may reach under a raised transparent panel to serve himself. Such conventional configurable food shields include a single transparent panel which may be set in a lowered position (i.e., a cafeteria mode), blocking access by patrons of the restaurant to the displayed food product, and in a raised position (i.e., a self-serve mode) so that patrons may reach under the raised transparent panel and serve themselves with food product. The single transparent panel of such conventional food shields are either adjustable angularly on the vertical support posts to convert from a cafeteria mode to a self-serve mode, or slidably retractable on a track system between cafeteria and self-serve positions.

The transparent panel of such conventional food shields is quite heavy, and may reach a length of four feet and a width of eighteen inches to two feet. As such, they are difficult to maneuver by the restaurant employee.

Also, since conventional, bi-positionable food shields employ a single glass or acrylic transparent panel, the positions in which the transparent panel may be placed are limited. The transparent panel of such bi-positionable food shields, when in the raised, self-serve position to allow patrons to reach the food product under the panel, may not provide adequate protection for the displayed food product from airborne bacteria transmitted by a restaurant patron.

Furthermore, it would be advantageous to use the transparent panel for purposes other than just as a bacteria barrier, for example, as a shelf for displaying food product that is closer and more visible to the patron but is still protected from contamination. Because of the limited positions in which a single transparent panel may be placed, such conventional food shields do not have this capability.

OBJECTS AND SUMMARY OF THE INVENTION

It is an object of the present invention to provide a food shield that is configurable in multiple positions.

It is another object of the present invention to provide an improved locking mechanism or assembly for use with a food shield, which locking mechanism allows a transparent panel of the food shield to be adjustably locked in a particular angular disposition between vertical supporting posts.

It is still another object of the present invention to provide a food shield having a pair of overlapping transparent panels, where the angular disposition of each transparent panel may be easily adjusted by a restaurant employee to various positions.

It is a further object of the present invention to provide a multi-positionable, folding food shield having overlapping transparent panels in which the transparent panels may be adjusted to a cafeteria setting, a self-serve setting and a combination self-serve and display setting.

It is yet a further object of the present invention to provide a food shield which overcomes the inherent disadvantages of conventional food shields.

In one form of the present invention, a food shield includes a pair of partially overlapping upper and lower transparent panels, each being formed from an acrylic or glass pane, first and second locking mechanisms or assemblies connected to and supporting one lateral side of each of the upper and lower transparent panels, and first and second non-locking mechanisms or assemblies connected to and supporting the opposite lateral side of each of the transparent panels. Each of the first locking and non-locking mechanisms, which supports the upper transparent panel, is mountable to a respective vertical support post. The second locking and non-locking mechanisms, which support the lower transparent panel, are pivotally joined respectively to the first locking and non-locking mechanisms. Both the first and second locking mechanisms and the first and second non-locking mechanisms allow the upper and lower transparent panels to be adjusted in their angular disposition between the support posts and locked into a desired position by the locking mechanisms from only one lateral side of each of the transparent panels, which is a clear advantage over many conventional food shields, as a restaurant employee need not try to reach across the width of the panels to make the adjustments.

The food shield of the present invention may be transformed into three different settings. In the cafeteria setting, the upper and lower transparent panels overlap each other to provide a full length barrier in front of the food product being displayed. When in such a setting, adjustment of the upper transparent panel to a desired angle using the first locking mechanism will also adjust the lower transparent panel to the same desired angle without the need to use the second locking mechanism. Alternatively, the first and second transparent panels may be adjusted independently of each other to different angular dispositions, if so desired.

The food shield of the present invention may also be adjusted to a self-serve setting. This is where the lower panel is pivoted inwardly of the food shield such that it resides in close proximity to the inside surface of the upper transparent panel. The lower transparent panel is now out of the way to allow a restaurant patron to reach under the upper transparent panel to help himself to any food product displayed behind the food shield, such as with a salad bar.

In a third setting of the food shield of the present invention, which is referred to herein as a combination self-serve and display setting, the lower transparent panel may be adjusted to a horizontal position to create a shelf situated behind the upper transparent panel. In this setting, food product may rest on and be supported by the horizontally disposed lower transparent panel, for example, to more visibly show for a restaurant patron an example of the food product made available to him by his reaching under the upper transparent panel.

It should be realized that the first and second non-locking mechanisms of the food shield of the present invention are free spinning and will rotate to whatever angle is chosen for the upper and lower transparent panels selected by the restaurant employee using the first and second locking mechanisms. Thus, the food shield of the present invention advantageously allows the upper and lower transparent panels to be adjusted angularly by a restaurant employee from only one lateral side thereof.

The locking mechanisms are also an important feature of the food shield of the present invention. Each of the first and second locking mechanisms includes support brackets which are joined to and support either the upper transparent panel or the lower transparent panel on one lateral side of each panel. The upper panel support bracket is rotatably mounted on a locking chamber barrel that is affixed to one of the vertical posts of the food shield. The upper panel support bracket includes a plurality of shallow recesses formed in a surface of the bracket that faces an end face of the locking chamber barrel. A first bore extends from the end face into the body of the locking chamber barrel and is met by a transverse second bore that extends into the barrel body from a side wall thereof. In this second bore is located a retractable spring-loaded plunger, on an exposed end of which is attached a pull knob for the restaurant employee to grasp. In the first bore is located an inner ball bearing, a spacer rod and an outer ball bearing. The plunger is capable of contacting the inner ball bearing under the bias of a spring of the plunger. The plunger is offset diametrically from the inner ball bearing so that it engages the ball bearing tangentially or chordally. This contact causes the inner ball bearing to move within the axially extending first bore, forcing the spacer rod and the outer ball bearing to move in a direction towards the surface of the end face of the locking chamber barrel such that the outer ball bearing extends at least partially outwardly of the end face and is received at least partially by one of the recesses formed in the side surface of the upper panel support bracket. This locks the locking chamber barrel and the first panel support bracket together to prevent relative movement therebetween and, concomitantly, maintains the upper transparent panel in a desired angular position that is set by the restaurant employee by extending and releasing the pull knob attached to the spring-loaded plunger.

The second locking assembly also includes a support bracket for attaching to and supporting a lateral side of the lower transparent panel. The lower panel support bracket is pivotally mounted to the upper panel support bracket of the first locking assembly. A side surface of the lower panel support bracket faces a lateral surface of the upper panel support bracket. The side surface of the lower panel support bracket also includes a plurality of shallow recesses formed therein. A first bore extends into the body of the upper panel support bracket from the lateral surface thereof. A second, transverse bore extends from a rear wall of the upper panel support bracket to intersect at preferably a right angle the first, laterally extending bore. This transversely extending second bore receives another retractable, spring-loaded plunger, and the laterally extending first bore receives inner and outer ball bearings and a spacer rod interposed therebetween. A second pull knob is attached to the exposed end of the retractable, spring-loaded plunger.

This second locking assembly operates in a manner similar to that of the first locking assembly. The plunger is offset diametrically from the inner ball bearing so that it engages the inner ball bearing tangentially or chordally. This contact causes the inner ball bearing to move within the laterally extending bore of the lower panel support bracket, forcing the spacer rod and the outer ball bearing to move within the bore in a direction towards the lateral surface of the upper panel support bracket such that the outer ball bearing at least partially protrudes from the lateral surface and is received at least partially by one of the shallow recesses formed in the side surface of the lower panel support bracket. Thus, by the restaurant employee pulling outwardly on the pull knob, the plunger is retracted to release pressure on the inner ball bearing so that the lower transparent panel may be angularly adjusted to a desired position. When the restaurant employee releases the pull knob, the spring-loaded plunger again engages the inner ball bearing which, in turn, causes the outer ball bearing to be more deeply received by one of the plurality of recesses formed in the side surface of the lower panel support bracket to fix the lower transparent panel in a desired angular position.

The first and second non-locking mechanisms are free spinning and will rotate to whatever angle is chosen for the upper and lower transparent panels selected by the restaurant employee. Each of the first and second non-locking assemblies includes a support bracket which is respectively joined to and supports the opposite lateral sides of the upper and lower transparent panels. The first non-locking assembly is mounted to another vertical post of the food shield, and the second non-locking assembly is pivotally mounted to the first non-locking assembly.

These and other objects, features and advantages of the present invention will become apparent from the following detailed description of illustrative embodiments thereof, which is to be read in connection with the accompanying drawings.

DETAILED DESCRIPTION OF THE PREFERRED EMBODIMENTS

Figure 1:
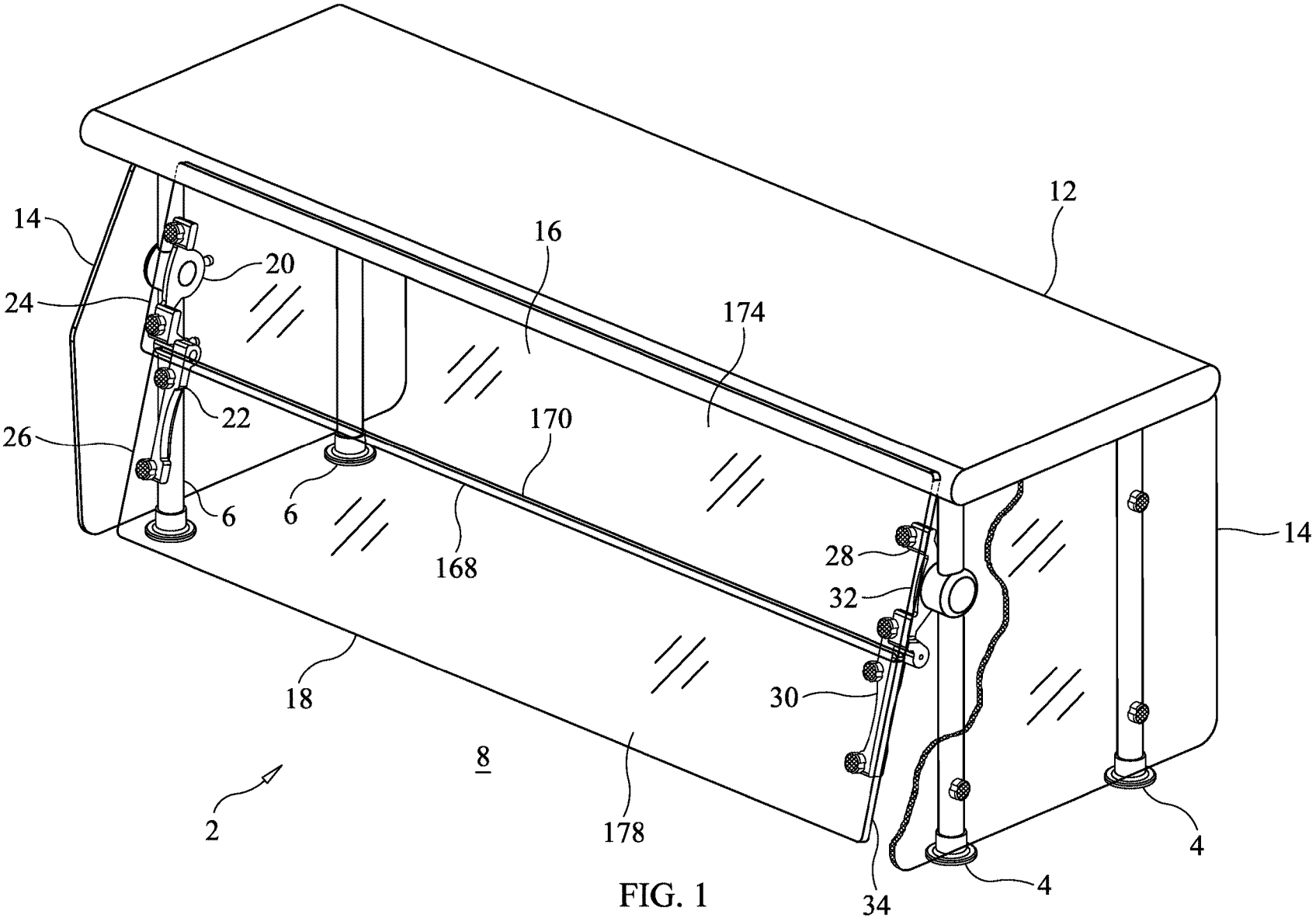
FIG. 1 is a front perspective view of the food shield of the present invention in which the transparent panels thereof are adjusted to a cafeteria setting.

Initially referring to FIGS. 1-6 of the drawings, it will be seen that a multi-positionable, folding food shield 2 configurable for use in cafeteria, self-serve and self-serve with display modes constructed in accordance with the present invention includes a pair of left vertical posts 4 spaced apart from each other and a pair of right vertical posts 6 also spaced apart from each other and from the left vertical posts 4. The left and right vertical posts 4, 6 may be mounted on a supporting surface 8, such as a horizontal table, work surface or display surface on which food product 10 is prepared or displayed in a restaurant establishment. The left and right vertical posts 4, 6 extend upwardly and support a horizontal top shelf 12. Transparent side panels 14 are mounted on the left and right vertical posts 4, 6 on the outside thereof and extend between the supporting surface or table 8 on which the food shield 2 is mounted and the top shelf 12.

As can be seen from FIGS. 1-6 of the drawings, the food shield 2, which is also commonly referred to in the food service industry as a "sneeze guard", includes upper and lower transparent panels 16, 18. Each of the upper and lower transparent panels 16, 18 may be formed from a framed or unframed planar sheet of clear acrylic material or safety or tempered glass. The upper and lower transparent panels 16, 18 are mounted on and supported by first and second locking assemblies 20, 22 on one lateral side 24, 26 thereof, and are mounted on and supported by first and second non-locking assemblies 28, 30 on the opposite lateral side 32, 34 thereof. The first and second locking, panel support assemblies 20, 22 and the first and second non-locking, panel support assemblies 28, 30 are mounted to respective vertical support posts, either the front left vertical support post 4 or the front right vertical support post 6, with the transparent panels 16, 18 essentially extending between the left and right support posts 4, 6. The first and second locking assemblies 20, 22 and the first and second non-locking assemblies 28, 30 of the food shield 2 are positioned at a desired height along the axial length of the left and right support posts 4, 6, and permit the transparent panels 16, 18 to be adjusted angularly in desired positions so as to best serve the requirements of the restaurant or food service establishment in which the food shield 2 is located in preventing contamination of food 10 displayed on one side of the transparent panels 16, 18 from airborne bacteria transmitted by customers and restaurant patrons on the opposite side of the panels 16, 18, and yet not unduly restrict the customers' access to the food 10, if so desired.

Figure 7:
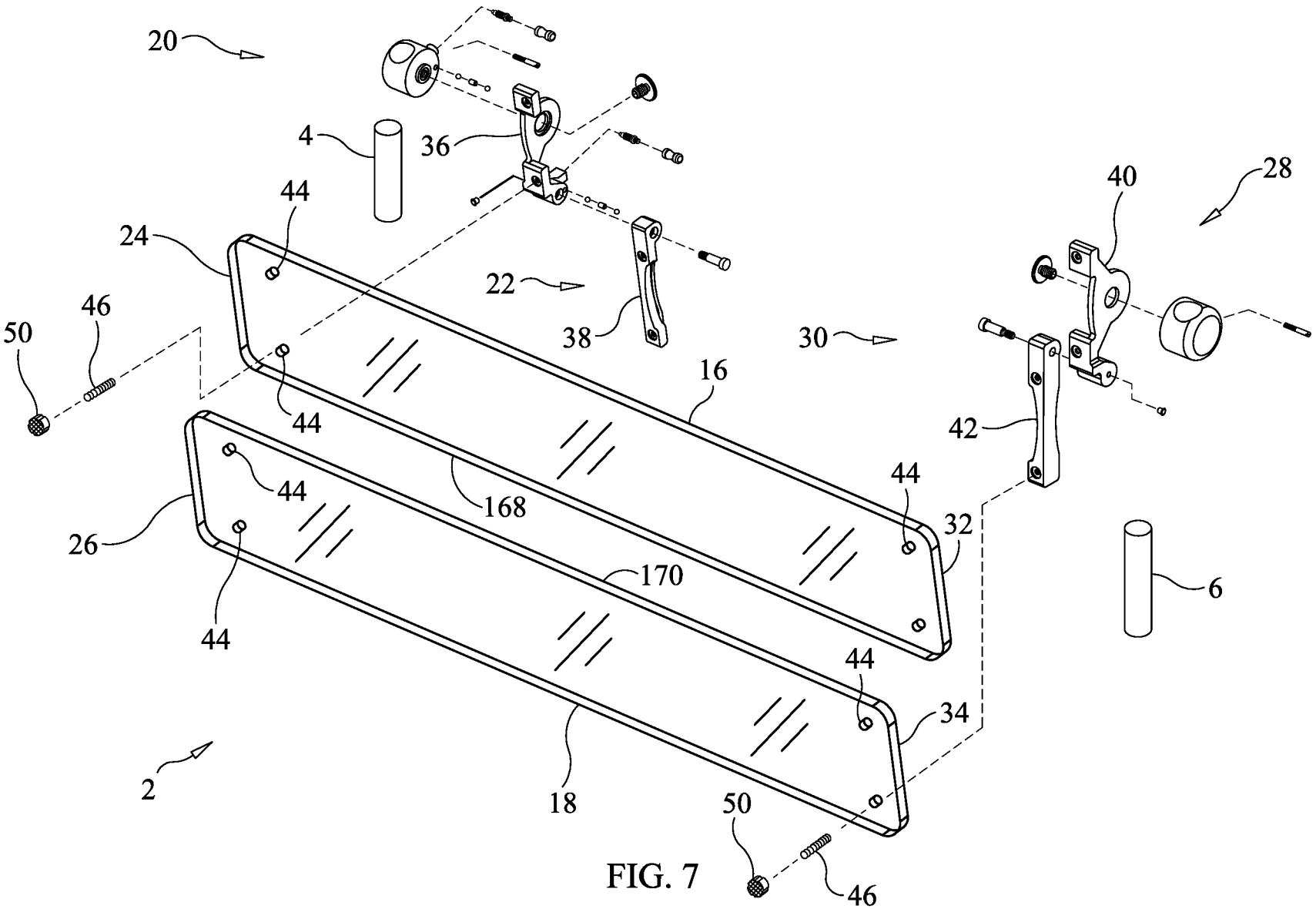
FIG. 7 is an exploded, front perspective view of the food shield of the present invention.

As can be seen from FIG. 7 of the drawings, each of the first and second locking assemblies 20, 22 and each of the first and second non-locking assemblies 28, 30 include a panel support bracket 36, 38, 40, 42, respectively, on which the first and second transparent panels 16, 18 are mounted. More specifically, a pair of holes 44 is formed through the thickness of the first transparent panel 16 on each lateral side portion 24, 32 of the panel 16. The holes 44 receive threaded studs 46 extending outwardly from each of the upper panel support brackets 36, 40 of the first locking and non-locking assemblies 22, 28. Threaded knobs 50 are screwed onto the ends of the studs 46 that extend through the upper transparent panel 16 to secure the panel 16 to the upper panel support brackets 36, 40 of the first locking and non-locking assemblies 20, 28.

Similarly, a pair of holes 44 is formed through the thickness of the lower transparent panel 18 on each lateral side portion 26, 34 of the panel 18. The holes 44 receive threaded studs 46 extending outwardly from each of the lower panel support brackets 38, 42 of the second locking and non-locking assemblies 22, 30. Threaded knobs 50 are screwed onto the ends of the studs 46 that extend through the lower transparent panel 18 to secure the panel 18 to the lower panel support brackets 38, 42 of the second locking and non-locking assemblies 22, 30.

Figure 8:
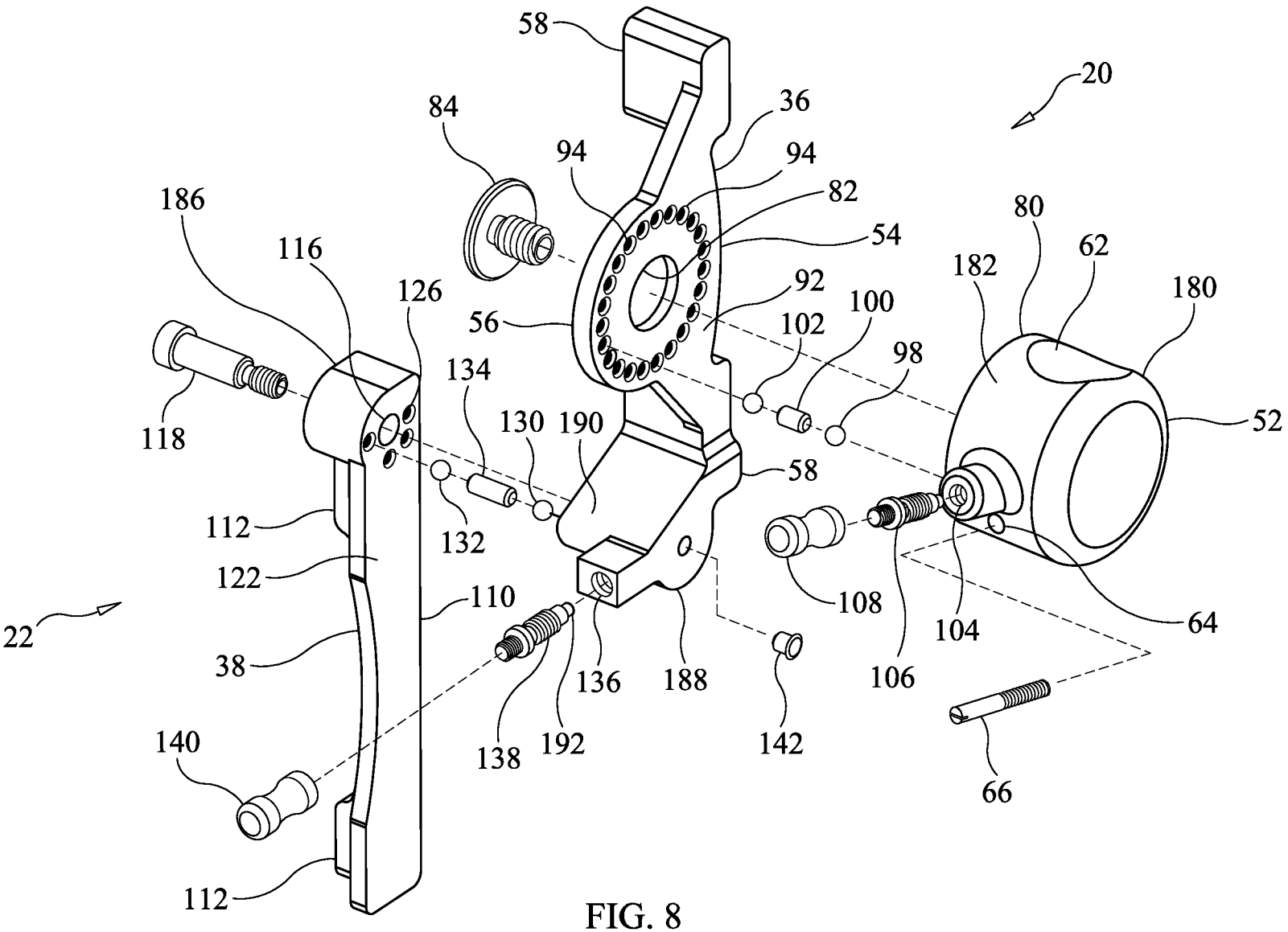
FIG. 8 is a right side, exploded perspective view of the first and second locking assemblies of the food shield of the present invention.
Figure 9:
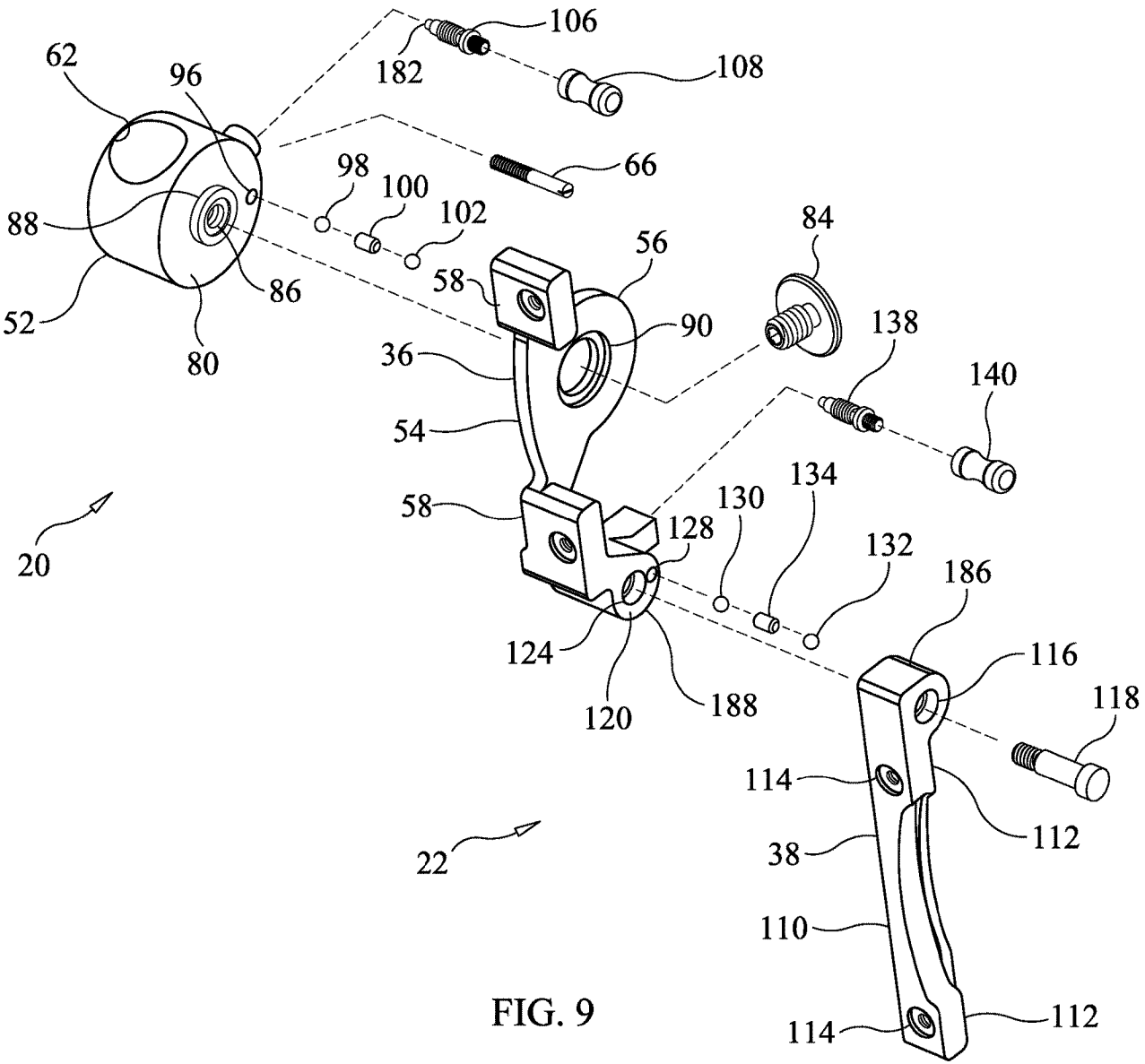
FIG. 9 is a left side, exploded perspective view of the first and second locking assemblies of the food shield of the present invention.
Figure 10:
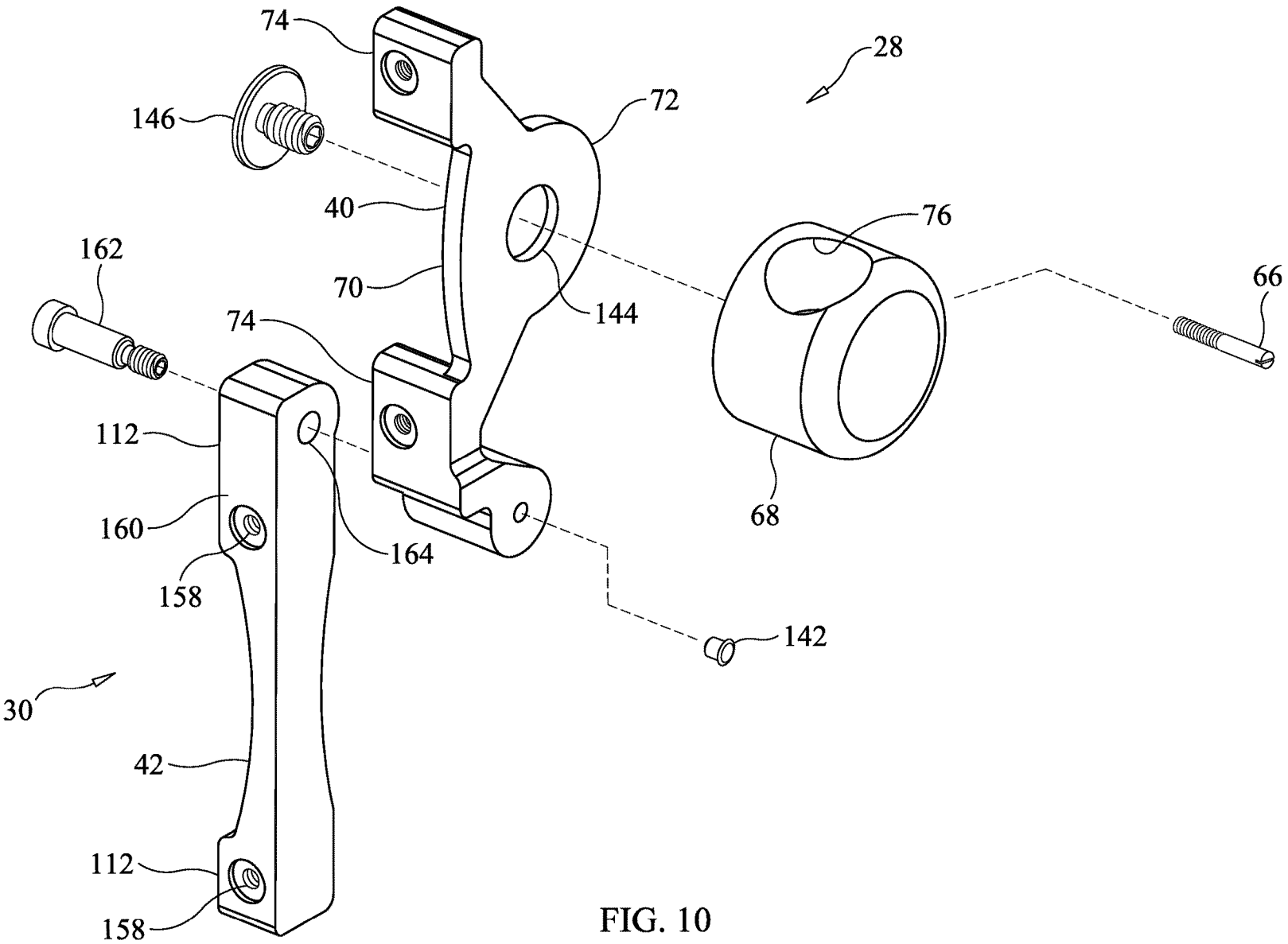
FIG. 10 is a right side, exploded perspective view of the first and second non-locking assemblies of the food shield of the present invention.
Figure 11:
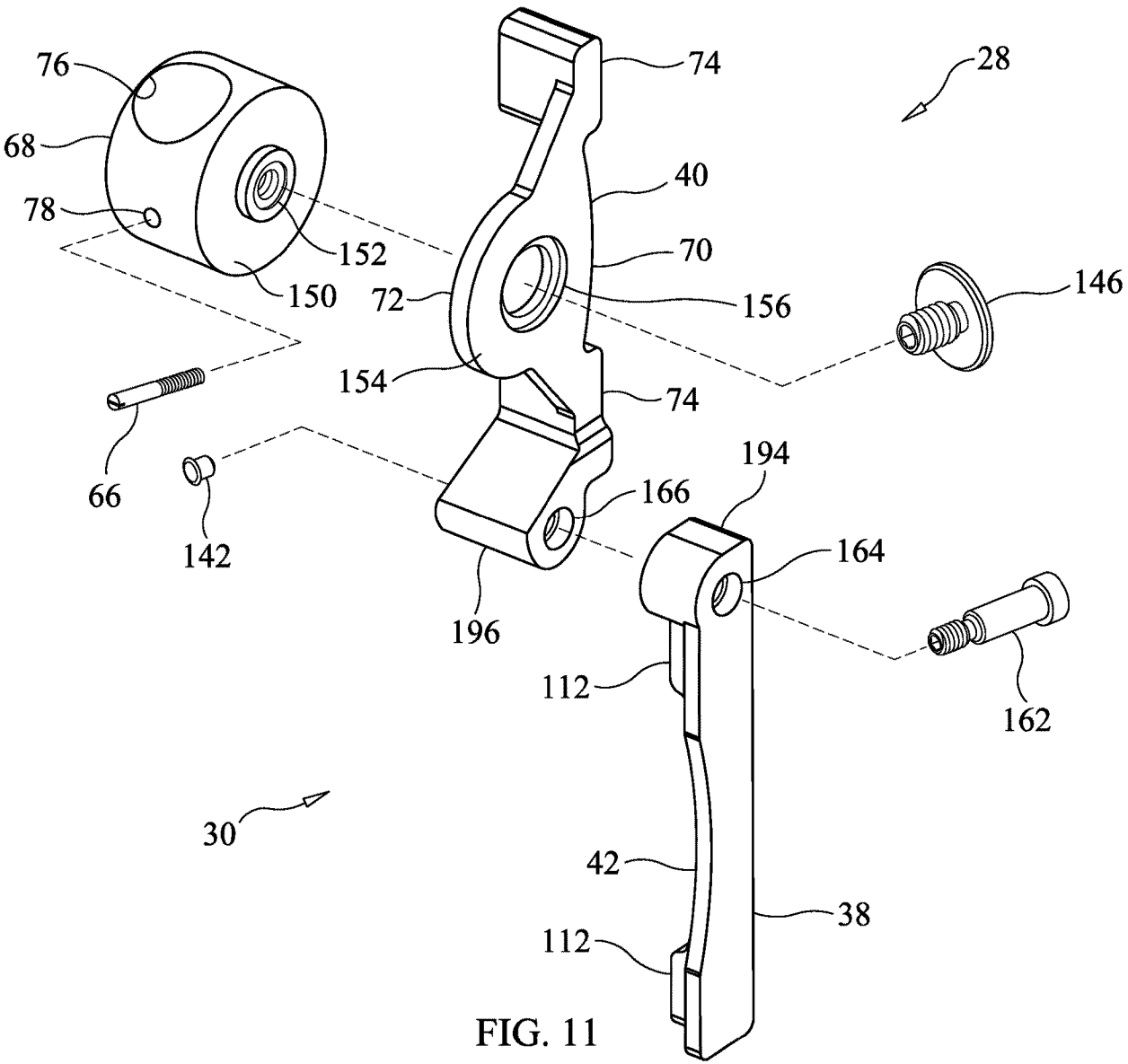
FIG. 11 is a left side, exploded perspective view of the first and second non-locking assemblies of the food shield of the present invention.

FIGS. 8-11 of the drawings show the components of the food shield 2 of the present invention in greater detail. More specifically, FIGS. 8 and 9 show the details of the first and second locking assemblies 20, 22 respectively viewed from the right side and the left side thereof, and FIGS. 10 and 11 show the details of the first and second non-locking assemblies 28, 30 respectively viewed from the right side and the left side thereof. The components of a preferred form of the first and second locking assemblies 20, 22, shown in FIGS. 8 and 9 of the drawings, will now be described.

The first locking assembly 20 preferably includes a locking chamber barrel 52 and an upper panel support bracket 36 rotatably affixed to the locking chamber barrel 52. The upper panel support bracket 36 includes a main body 54 formed with a central cylindrical hub 56, and two spaced apart support flanges 58 extending perpendicularly outwardly from a surface of one side of the main body 54. Each flange 58 includes a threaded bore 60 formed in its upper surface. Each threaded bore 60 receives a threaded stud 46, which is used for securing the upper transparent panel 16 to the upper panel support bracket 36 of the first locking assembly 20.

The locking chamber barrel 52 of the first locking assembly 20 is generally cylindrical in shape, and includes a first bore 62 passing diametrically through the thickness of the barrel 52. The first bore 62 is dimensioned to receive one of the vertical support posts, either the front left support post 4 or the front right support post 6, so that the locking chamber barrel 52 may be mounted on a support post 4, 6 at a desired position along the axial length thereof.

The locking chamber barrel 52 of the first locking assembly 20 has a second bore 64 formed therein which radially extends from the exterior surface of the barrel 52 into the first, larger diameter bore 62 which receives the support post 4, 6. This second, smaller diameter bore 64, the axis of which is disposed perpendicularly to the axis of the first bore 62, is threaded and receives a threaded set screw 66. The threaded set screw 66 has a slotted, Phillips, hexagonal socket or like head and may be turned with a screwdriver or Allen wrench to advance the threaded set screw 66 into the barrel 52 and so that the other axial end of the set screw 66 extends into the support post bore 62 of the barrel 52.

Now turning to FIGS. 10 and 11 of the drawings, it will be seen that the first non-locking assembly 28 also includes an upper panel support bracket 40 and a non-locking chamber barrel 68. The upper panel support bracket 40 of the first non-locking assembly 28 is similar in shape and structure to the shape and structure of the upper panel support bracket 36 of the first locking assembly 20, and also includes a main body 70 formed with a central cylindrical hub 72 and two spaced apart support flanges 74 extending perpendicularly outwardly from a surface of one side of the main body 70 so that the flanges 74 of the upper panel support bracket 40 of the first non-locking assembly 28 face the flanges 58 of the upper panel support bracket 36 of the first locking assembly 20.

The non-locking chamber barrel 68 of the first non-locking assembly 28 is also generally cylindrical in shape, and includes a first bore 76 passing diametrically through the thickness of the barrel 68. The first bore 76 is dimensioned to receive one of the vertical support posts, either the front left support post 4 or the front right support post 6, so that the non-locking chamber barrel 68 may be mounted on a respective support post 4, 6 at a desired position along the axial length thereof.

Like the locking chamber barrel 52, the non-locking chamber barrel 68 of the first non-locking assembly 28 has a second bore 78 formed therein which radially extends from the exterior surface of the barrel 68 into the first, larger diameter bore 76 which receives the support post 4, 6. This second, smaller diameter bore 78, the axis of which is disposed perpendicularly to the axis of the first bore 76, is threaded and receives a threaded set screw 66 having a slotted, Phillips, hexagonal socket or like head. The set screw 66 may be turned with a screwdriver or Allen wrench to advance the set screw 66 into the support post bore 76 of the non-locking chamber barrel 68.

The vertical support posts 4, 6 may include one or more holes (not shown) formed therein along their axial lengths. The barrels 52, 68 of the first locking assembly 20 and the first non-locking assembly 28 may be positioned on their respective support posts 4, 6 such that the second bores 64, 78 formed in the barrels 52, 68 are in alignment with a selected hole formed in the support posts 4, 6. The set screws 66 may be turned by their slotted, Phillips, or hexagonal heads using a screwdriver or Allen wrench to advance the set screws 66 into corresponding holes formed in the support posts 4, 6 to secure the first locking assembly 20 and the first non-locking assembly 28 of the food shield 2 to their respective support posts 4, 6 on which they are mounted.

Returning again to FIGS. 8 and 9 of the drawings, the first and second locking, panel support assemblies 20, 22 will now be described in greater detail. As shown in the figures, it will be seen that the chamber barrel 52 of the first locking assembly 20 includes a flat end face 80. The upper panel support bracket 36 is rotatably mounted to the chamber barrel 52 at the flat end face 80 thereof.

The center hub 56 of the upper panel support bracket 36 includes a central opening 82 formed through the thickness thereof through which passes the threaded shank of a cap bolt 84. The end face 80 of the chamber barrel 52 includes a centrally disposed threaded bore 86 which receives the threaded shank of the cap bolt 84 to secure the upper panel support bracket 36 to the locking chamber barrel 52.

Even more specifically, the locking chamber barrel 52 includes a boss 88 that extends outwardly from the end face 80 of the locking chamber barrel 52, which boss 88 is diametrically dimensioned to be received by the opening 82 formed in the upper panel support bracket 36 on one lateral side thereof. The other lateral side of the upper panel support bracket 36 surrounding the central opening 82 formed therein is recessed to define a larger diameter opening 90, which larger diameter opening 90 is dimensioned to receive the enlarged head of the cap bolt 84. As mentioned previously, the cap bolt 84 secures the upper panel support bracket 36 to the locking chamber barrel 52 and permits the upper panel support bracket 36 to rotate on the chamber barrel 52.

The surface of the lateral side 92 of the upper panel support bracket 36 which faces the locking chamber barrel 52 includes a plurality of spaced apart shallow recesses 94 formed therein and arranged in a circle about the center hub 56 of the main body 54 of the upper panel support bracket 36. The end face 80 of the locking chamber barrel 52 which faces the side 92 of the upper panel support bracket 36 that has the plurality of recesses 94 formed therein includes an off-center, axially extending third bore formed therein which extends axially into the body of the locking chamber barrel 52. This third, off-center bore 96 is situated on the end face 80 of the locking chamber barrel 52 in alignment with the circular arrangement of recesses 94 formed in the upper panel support bracket 36.

Within this third, off-center bore 96 is received an inner ball bearing 98, a cylindrical spacer rod 100 and an outer ball bearing 102, the inner ball bearing 98 being situated more deeply in the third bore 96 formed in the locking chamber barrel 52, and the outer ball bearing 102 being more closely situated and at least partially extending outwardly from the end face 80 of the locking chamber barrel 52. As will be explained, this outer ball bearing 102 will be received in one recess 94 of the plurality of recesses 94 formed in the side 92 of the upper panel support bracket 36 to lock the upper panel support bracket 36 to the locking chamber barrel 52 and to prevent rotational movement of the support bracket 36 on the locking chamber barrel 52.

There is a fourth bore 104 that is formed in the locking chamber barrel 52, and this bore 104 extends transversely to the off-center, axial third bore 96 into the chamber barrel body from a side wall of the barrel 52 such that it intersects the off-center, axially extending third bore 96. This transverse fourth bore 104 receives a retractable, spring-loaded plunger 106 which is capable of contacting the inner ball bearing 98 under the bias of a spring forming part of the retractable, spring-loaded plunger 106. The retractable, spring-loaded plunger 106 may be Part Number CL-4-HRPT-S manufactured by Carr Lane Manufacturing Co. of Shrewsbury, Mo.

The third bore 96 and the fourth bore 104 are arranged such that the plunger 106 is offset diametrically from the inner ball bearing 98 so that it engages the ball bearing 98 tangentially or chordally. As in the game of billiards, this offset contact between the plunger 106 and the inner ball bearing 98 causes the inner ball bearing 98 to move within the axially extending third bore 96, forcing the interposed spacer rod 100 and outer ball bearing 102 in contact with each other to also move within the axially extending third bore 96 in a direction towards the end face 80 of the locking chamber barrel 52 such that the outer ball bearing 102 extends at least partially outwardly of the end face 80 and is at least partially received by one of the recesses 94 formed in the side 92 of the upper panel support bracket 36. This locks the locking chamber barrel 52 and the upper panel support bracket 36 together to prevent relative movement therebetween and, concomitantly, maintains the upper transparent panel 16 in a desired angular position between the left and right vertical support posts 4, 6 of the food shield 2.

A pull knob 108 is attached to the exposed end of the retractable, spring-loaded plunger 106 and is graspable by a restaurant employee to pull the plunger 106 outwardly away from contact with the inner ball bearing 98. This releases the force exerted by the inner ball bearing 98 on the spacer rod 100 and the outer ball bearing 102 and provides additional axial space within the third bore 96 for the ball bearings 98, 102 and spacer rod 100 to retract therein. The outer ball bearing 102 may now be rolled across the side surface 92 of the upper panel support bracket 36 from one recess 94 to another, as the recesses 94 are relatively shallow and preferably have sloping, curved or beveled side walls where they meet the side surface 92 of the support bracket 36, when the restaurant employee grasps the upper transparent panel 16 and moves it into a desired position. When the restaurant employee releases the pull knob 108, the plunger 106, under the bias of the plunger spring, returns to its inwardly disposed position within the transverse fourth bore 104 to again tangentially or chordally engage the inner ball bearing 98 which, in turn, forces the outer ball bearing 102, through the spacer rod 100, more deeply into a recess 94 formed in the upper panel support bracket 36 that is in alignment with the outer ball bearing 102.

The second locking assembly 22 will now be described and is shown in FIGS. 8 and 9 of the drawings. The second locking assembly 22 includes a lower panel support bracket 38 having a main body 110 and two spaced apart support flanges 112 extending outwardly in opposite directions from the main body 110. Each flange 112, like the flanges 58, 74 of the upper panel support brackets 36, 40 of the first locking and non-locking assemblies 20, 28, includes a threaded bore 114 formed in a surface thereof. Each threaded bore 114 receives a threaded stud 46, which is used for securing the lower transparent panel 18 to the lower panel support bracket 38 of the second locking assembly 30.

The lower panel support bracket 38 is rotatably mounted to preferably the lower end of the upper panel support bracket 36 of the first locking assembly 20. More specifically, the upper end portion of the lower panel support bracket 38 has a bore 116 formed through the thickness thereof laterally, that is, from one lateral side to the other lateral side. This bore 116 receives a shoulder bolt 118 having a non-threaded upper shank portion and a threaded lower shank portion. In a side wall 120 of the upper panel support bracket 36 that faces a side wall 122 of the lower panel support bracket 38 a threaded bore 124 is formed to receive the threaded lower portion of the shoulder bolt 118 in order to secure the lower panel support bracket 38 to the upper panel support bracket 36 but allow the lower panel support bracket 38 to rotate on the upper panel support bracket 36.

As can be seen in FIG. 8 of the drawings, the side wall 122 of the lower panel support bracket 38 that faces the upper panel support bracket 36 includes a plurality of spaced apart, shallow recesses 126 formed in the surface thereof and situated in a circular arrangement around the shoulder bolt receiving bore 116 about the axis of which the lower panel support bracket 38 pivots on the upper panel support bracket 36. The lower portion of the upper panel support bracket 36 includes a first bore 128 that extends into the body of the upper panel support bracket 36 from a lateral side thereof. In the same manner as the locking chamber barrel 52 of the first locking assembly 20, this first bore 128 receives an inner ball bearing 130, an outer ball bearing 132 and a cylindrical spacer rod 134 interposed between the inner ball bearing 130 and the outer ball bearing 132, the inner ball bearing 130 being set more deeply into the first bore 128 and body of the upper panel support bracket 36, and the outer ball bearing 132 having a portion thereof which extends outwardly from the lateral side 120 of the upper panel support bracket 36 in which the first bore 128 is formed such that it is at least partially received by a recess 126 formed in the side wall 122 of the lower panel support bracket 38.

A second bore 136 is formed in the lower portion of the upper panel support bracket 36 on the rear side thereof (opposite from the side to which the upper transparent panel 16 is attached), this second bore 136 running transversely to the first bore 128 such that the two bores 128, 136 intersect one another within the body of the lower portion of the upper panel support bracket 36. The second bore 136 receives a retractable, spring-loaded plunger 138, which may be the same component as or similar to the retractable, spring-loaded plunger 106 received by the fourth bore 104 in the locking chamber barrel 52 of the first locking assembly 20. Like the first locking chamber barrel 52, the first bore 128 and the second bore 136 formed in the lower portion of the upper panel support flange 36 are positioned to intersect one another such that the plunger 138 is offset diametrically from the inner ball bearing 130 to engage the ball bearing 130 tangentially or chordally under the bias of the plunger spring. The first bore 128 formed in the lower portion of the upper panel support bracket 36 is situated in alignment with one or more of the recesses 126 formed in the lower panel support bracket 38 so that the outer ball bearing 132 may be received by one of the recesses 126.

The tangential or chordal contact of the plunger 138 with the inner ball bearing 130 causes the inner ball bearing 130 to move within the laterally extending first bore 128 of the upper panel support bracket 36, forcing the spacer rod 134 and the outer ball bearing 132, in contact with each other, to also move within the laterally extending first bore 128 in a direction toward the surface of the side wall 120 of the upper panel support bracket 36 and such that the outer ball bearing 132 protrudes at least partially outwardly from the surface of the side wall 120 and is at least partially received by one of the shallow recesses 126, which are also formed with sloping or beveled recess walls, formed in the side wall 122 of the lower panel support bracket 38. This locks the lower panel support bracket 38 and the upper panel support bracket 36 together to prevent relative movement therebetween and, concomitantly, maintains the lower transparent panel 18 in a desired angular position between the vertical support posts 4, 6 of the food shield 2.

A pull knob 140 is attached to the exposed end of the retractable, spring-loaded plunger 138 situated on the upper panel support bracket 36 and is graspable by a restaurant employee.

When the restaurant employee pulls outwardly on the pull knob 140 against the bias of the plunger spring, the plunger 138 retracts away from the inner ball bearing 130, which releases pressure on the spacer rod 134 and the outer ball bearing 132. Now, the outer ball bearing 132 may escape from a recess 126 formed in the lower panel support bracket 38, since space is provided for the inner and outer ball bearings 130, 132 and the spacer rod 134 to move inwardly of the first axial bore 128, when the restaurant employee grasps the lower transparent panel 18 and moves the panel 18 into a desired position.

When the restaurant employee releases the pull knob 140, the retractable, spring-loaded plunger 38 returns to its inward position within the second bore 136 and tangentially or chordally contacts the inner ball bearing 130, displacing the inner ball bearing 130, the spacer rod 134 in contact with the inner ball bearing 130 and the outer ball bearing 132 in contact with the spacer rod 134 outwardly of the laterally extending first bore 128 so that the outer ball bearing 132 protrudes from the surface of the side wall 120 of the upper panel support bracket 36 and is received more deeply in an aligned recess 126 formed in the lower panel support bracket 38 to prevent the lower panel support bracket 38 from rotating on the upper panel support bracket 36 and to thereby maintain the lower transparent panel 18 in a desired position.

If the threaded bore 124 extends entirely through the lower portion of the upper panel support bracket 36 to the opposite lateral side thereof, a cap 142 may be inserted into the bore 124 to close the opening in the opposite lateral side wall.

The first and second non-locking assemblies 28, 30 of the food shield 2 will now be described, and reference should be had to FIGS. 10 and 11 of the drawings. As can be seen from FIGS. 10 and 11 of the drawings, the first non-locking, upper panel support assembly 28 is mounted on the other, preferably front vertical support post 4, 6 and situated on the other lateral side 32 of the upper transparent panel 16 of the food shield 2, opposite to where the first locking assembly 20 and support post 4, 6 on which the locking assembly 20 is mounted. The first non-locking assembly 28 includes a non-locking chamber barrel 68 and an upper panel support bracket 40, as mentioned previously. The non-locking chamber barrel 68 has generally the same cylindrical shape as the locking chamber barrel 52 of the first locking assembly 20, as described previously, with a support post bore 76 formed diametrically through the side of the chamber barrel 68, and a smaller, threaded set screw bore 78 disposed perpendicularly to the support post bore 76 and formed radially through the barrel 68 from the side wall thereof and into the support post bore 76. A threaded set screw 66 is received by the set screw bore 78 to extend into the support post bore 76 and be received by a hole (not shown) formed in the vertical support post 4, 6 on which the non-locking chamber barrel 68 is mounted. The exposed, free end of the threaded set screw 66 includes a slot, Phillips head, hexagonal socket or the like so that it may be turned by the user of the food shield 2 using a screwdriver or Allen wrench so as to advance the set screw 66 into the chamber barrel 68 and the hole in the support post 4, 6 on which the first non-locking assembly 28 is mounted. The structure of the set screw 66, support post bore 76 and set screw bore 78 on the non-locking chamber barrel 68 of the first non-locking, upper panel support assembly 28 is preferably the same as or similar to that of comparable components on the locking chamber barrel 52 of the first locking, upper panel support assembly 20.

The upper panel support bracket 40 of the first non-locking assembly 28 is similar in shape to that of the upper panel support bracket 36 of the first locking assembly 20, with a main body 70 having a central, cylindrical hub portion 72, and spaced apart flanges 74 extending perpendicularly from a side surface of the bracket 40 on which one lateral side 32 of the upper transparent panel 16 rests. As also mentioned previously, the flanges 74 on the upper panel support bracket 40 of the first non-locking assembly 28 face the flanges 58 on the upper panel support bracket 36 of the first locking assembly 20.

There is an opening 144 formed through the thickness of the main body 70 of the upper panel support bracket 40 of the first non-locking assembly 28 situated at the central hub portion 72 thereof. Through this opening 144 is received the threaded shank of a cap bolt 146. The threaded shank of the cap bolt 146 is received by a threaded central opening 148 formed in a flat end face 150 of the chamber barrel 68 of the first non-locking assembly 28 so that the upper panel support bracket 40 is secured to the flat end face 150 of the chamber barrel 68 but rotatable thereon to allow angular movement of the upper transparent panel 16 of the food shield 2 mounted on the support bracket 40.

Preferably, a boss 152 extends outwardly from the surface of the end face 150 of the non-locking chamber barrel 68, and the opening 144 formed in the upper panel support bracket 40 is dimensioned to receive the boss 152. Furthermore, and more preferably, the lateral side 154 of the main body 70 of the upper panel support bracket 40 opposite the side which faces the end face 150 of the non-locking chamber barrel 68 is recessed about the central opening 144 to form a larger diameter opening 156 that receives the enlarged head of the cap bolt 146.

On the first non-locking assembly 28, the upper panel support bracket 40 preferably does not include the plurality of recesses 94 that are found on the upper panel support bracket 36 of the first locking assembly 20, and the flat end face 150 of the non-locking chamber barrel 68 preferably does not include a bore 96 or ball bearings 98, 102 and spacer rod 100 received in the bore 96 that are found on the chamber barrel 52 of the first locking assembly 20. Furthermore, there is no retractable, spring-loaded plunger 106 on the non-locking chamber barrel 68 or the upper panel support bracket 40 of the first non-locking assembly 28, as there are on the locking chamber barrel 52 and the upper panel support bracket 36 of the first locking assembly 20. Of course, the upper panel support bracket 40 and chamber barrel 68 of the first non-locking assembly 28 could be made with the same structure as the upper panel support bracket 36 and barrel 52 of the first locking assembly 20, as long as certain components are omitted, such as one or more of the outer ball bearing 102, spacer rod 100, inner ball bearing 98 or retractable, spring-loaded plunger 106, to allow the upper panel support bracket 40 to freely rotate on the non-locking chamber barrel 68. In another embodiment, the first and second locking assemblies 20, 22 may be included on both lateral sides 24, 32, 26, 34 of the upper and lower transparent panels 16, 18 respectively in place of the first and second non-locking assemblies 28, 30, but this would make it more difficult for an employee to adjust the angular disposition of the first and second transparent panels 16, 18, as such panels 16, 18 may be four feet or more in width.

As can further be seen from FIGS. 10 and 11 of the drawings, the second non-locking assembly 30 provides support for the lower transparent panel 18. The second non-locking assembly 30 includes a lower panel support bracket 42 that is rotatably mounted at the upper portion thereof to the lower portion of the upper panel support bracket 40 of the first non-locking assembly 28.

The lower panel support bracket 42 of the second non-locking assembly 30 includes a pair of spaced apart, threaded holes 158 into which studs 46 are received that extend perpendicularly outwardly therefrom. As mentioned previously, the studs 46 extend through the holes 44 formed through the thickness of the lower transparent panel 18 on one lateral side thereof 34 so that the lower transparent panel 18 rests on a side 160 of and is supported by the lower panel support bracket 42 of the second non-locking assembly 30.

A bolt 162 passes through a bore 164 formed through the thickness of the upper portion of the lower panel support bracket 38 from one lateral side thereof to the other lateral side, and its threaded shank is received by a threaded bore 166 formed in the lower portion of the upper panel support bracket 40 of the first non-locking assembly 28. The lower panel support bracket 38 is secured to the upper panel support bracket 40 of the first non-locking assembly 28 by the bolt 162 and rotates freely thereon. Of course, it should be understood that the lower panel support bracket 38 of the second non-locking assembly 30 may be made to have a similar structure to that of the lower panel support bracket 38 of the second locking assembly 22, but such should not be necessary, as all adjustments to the angular position of the upper transparent panel 16 and the lower transparent panel 18 are preferably made from one side of the food shield 2 by the first and second locking assemblies 20, 22. This makes it much easier for a restaurant employee to manage the food shield 2 when adjusting the positions of the transparent panels 16, 18.

Figure 2:
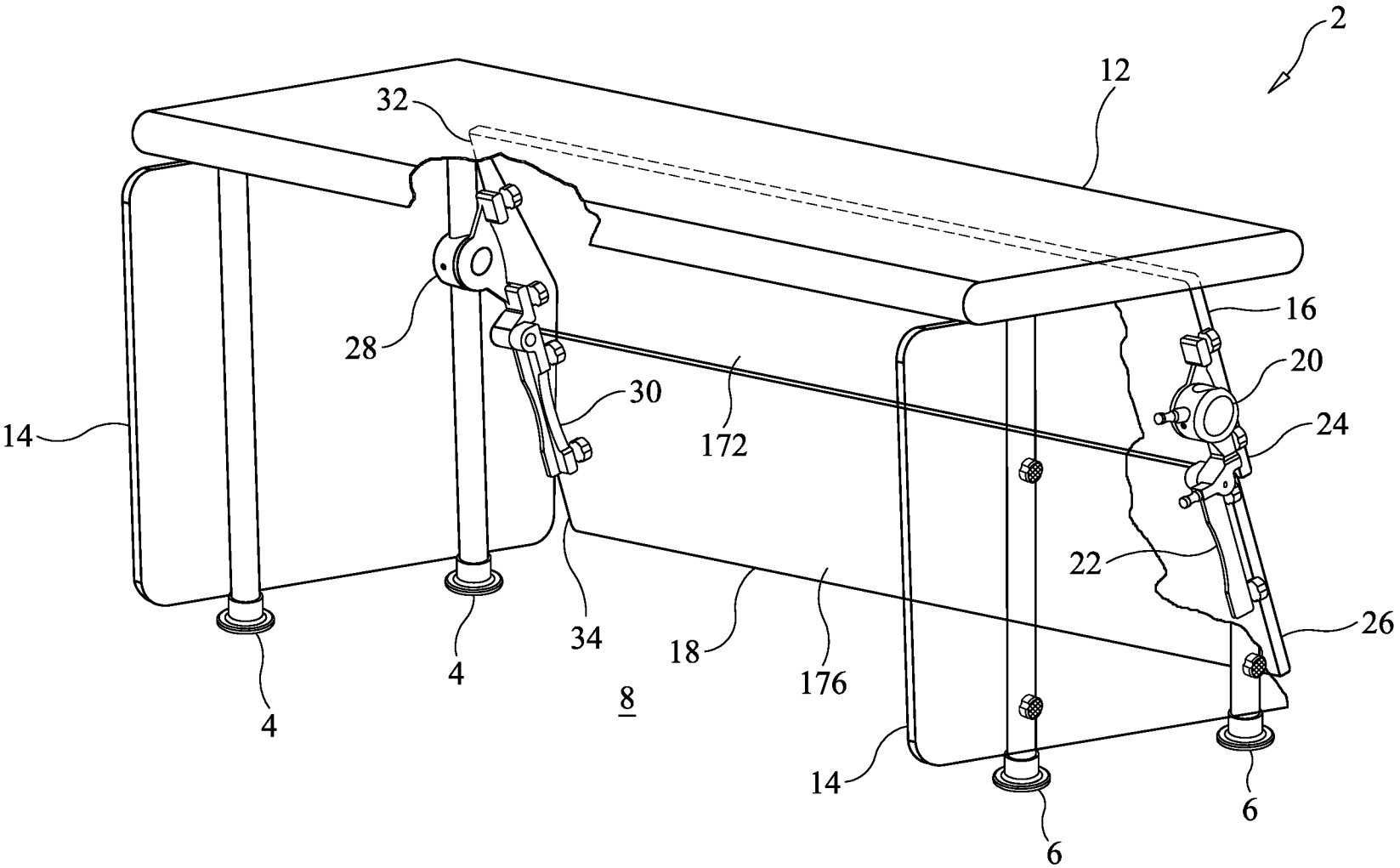
FIG. 2 is a rear perspective view of the food shield of the present invention in which the transparent panels thereof are adjusted to a cafeteria setting.

As can be seen from FIGS. 1 and 2 of the drawings, the lower portion 168 of the upper transparent panel 16 overlaps the upper portion 170 of the lower transparent panel 18 to provide a complete barrier from airborne bacteria transmitted by customers or restaurant patrons on the outer side of the panels 16, 18 to prevent contamination of food product 10 displayed on the inner side of the transparent panels 16, 18, especially when the food shield 2 of the present invention is in the cafeteria mode. Each of the upper transparent panel 16 and the lower transparent panel 18 may be adjusted angularly independently of one another.

The food shield 2 of the present invention, with its multi-positionable upper and lower transparent panels 16, 18, may be adjusted to operate in at least three different modes. As shown in FIGS. 1 and 2 of the drawings, in the cafeteria mode, the upper transparent panel 16 and the lower transparent panel 18 may be adjusted, with portions 168, 170 thereof overlapping, to provide a complete barrier so that food product 10 behind the transparent panels 16, 18 may be displayed but yet restaurant patrons may not reach under the panels 16, 18 to retrieve food product 10; in this mode, restaurant employees would serve the displayed food product 10 to the restaurant patrons.

Figure 3:
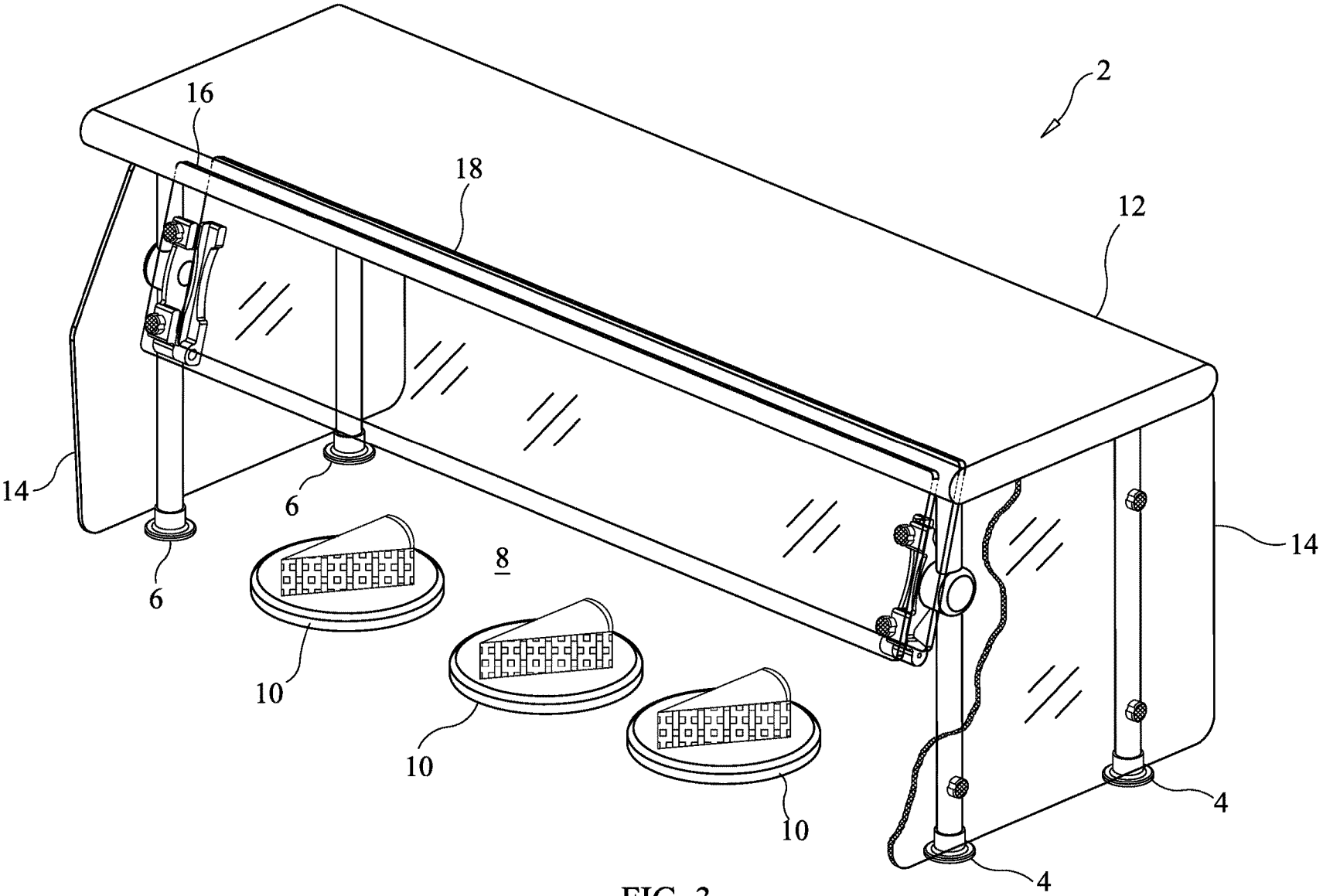
FIG. 3 is a front perspective view of the food shield of the present invention in which the transparent panels thereof are adjusted to a self-serve setting.
Figure 4:
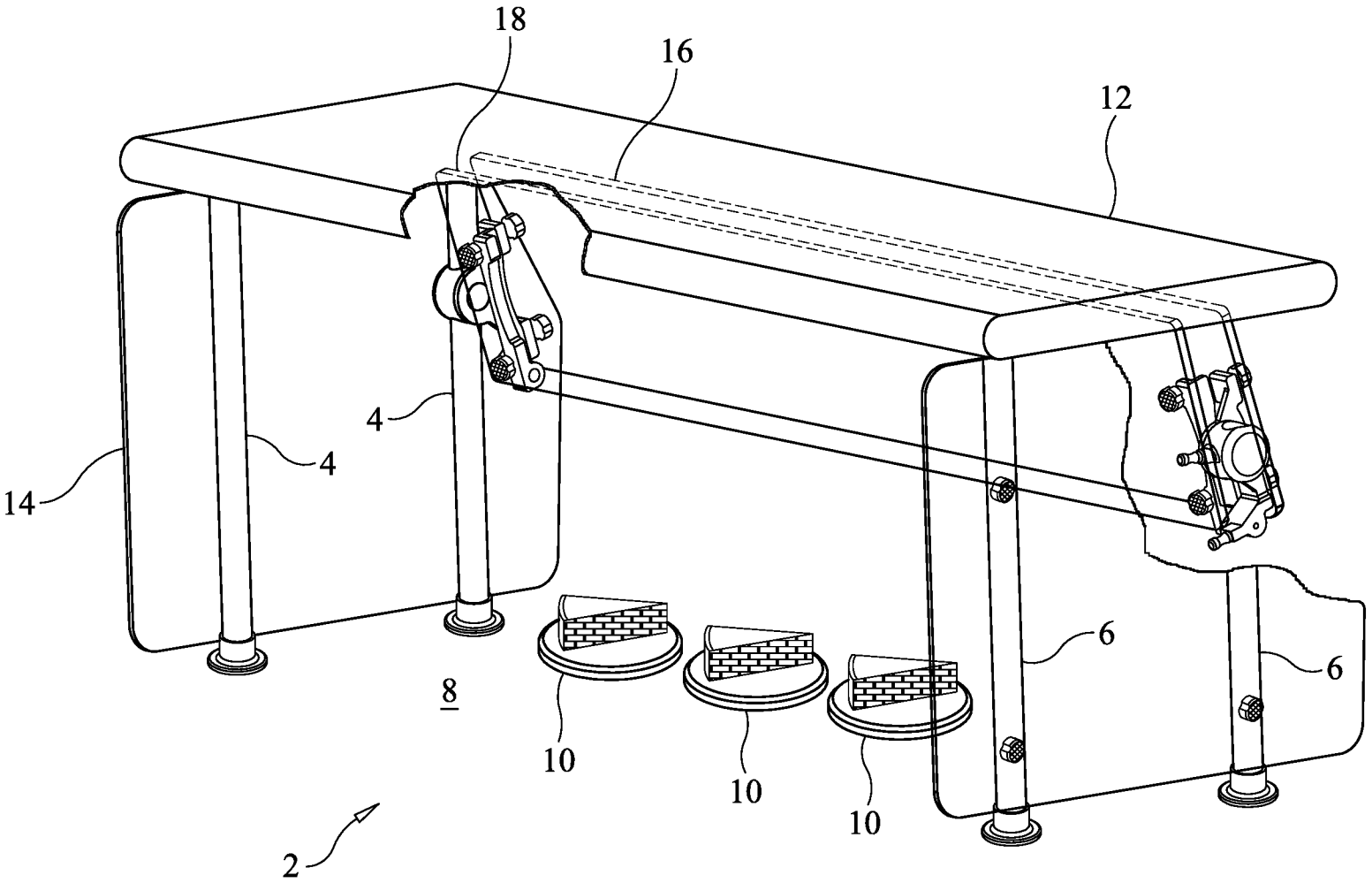
FIG. 4 is a rear perspective view of the food shield of the present invention in which the transparent panels thereof are adjusted to a self-serve setting.
Figure 5:
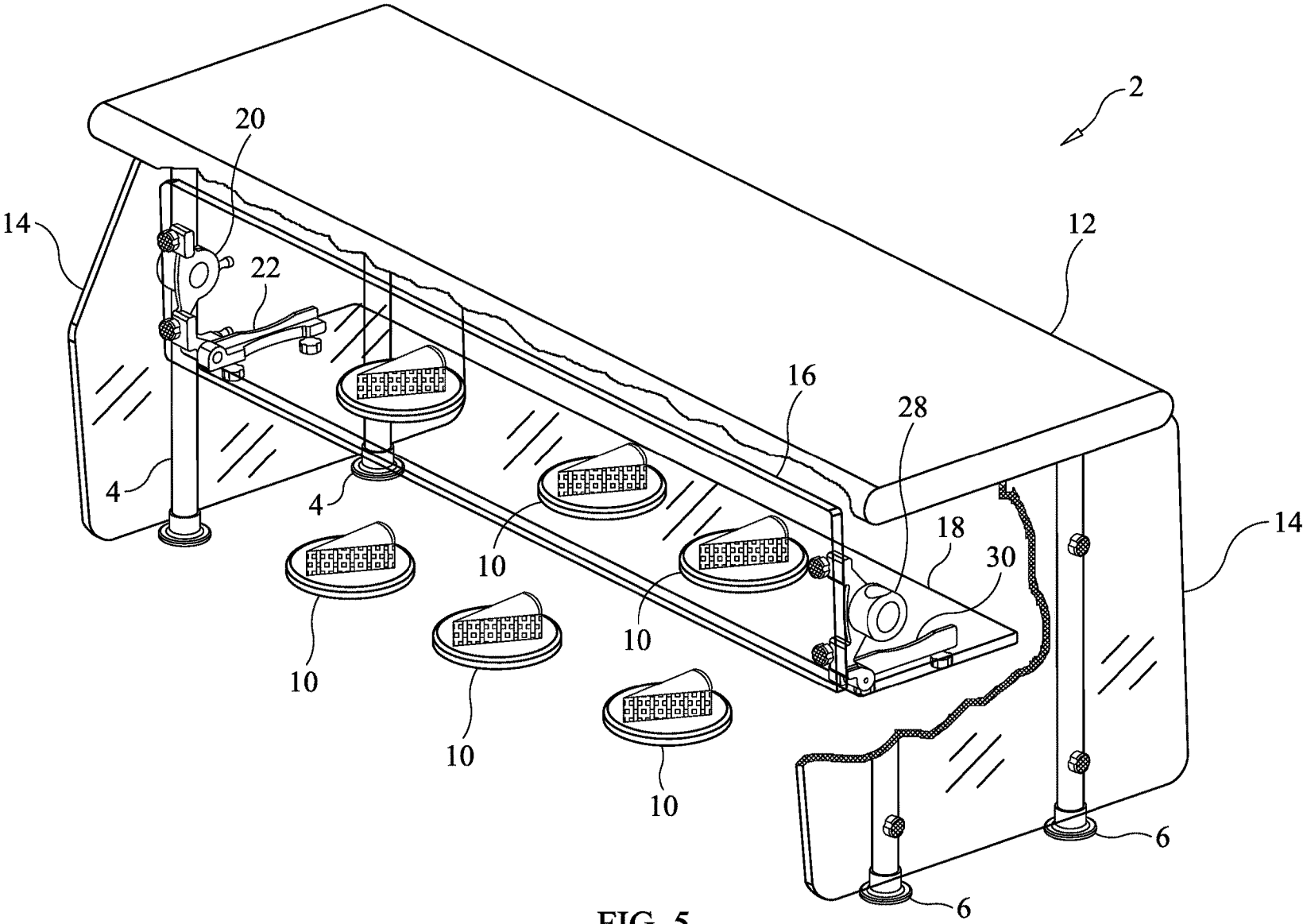
FIG. 5 is a front perspective view of the food shield of the present invention in which the transparent panels thereof are adjusted to a combination self-serve and display setting.
Figure 6:
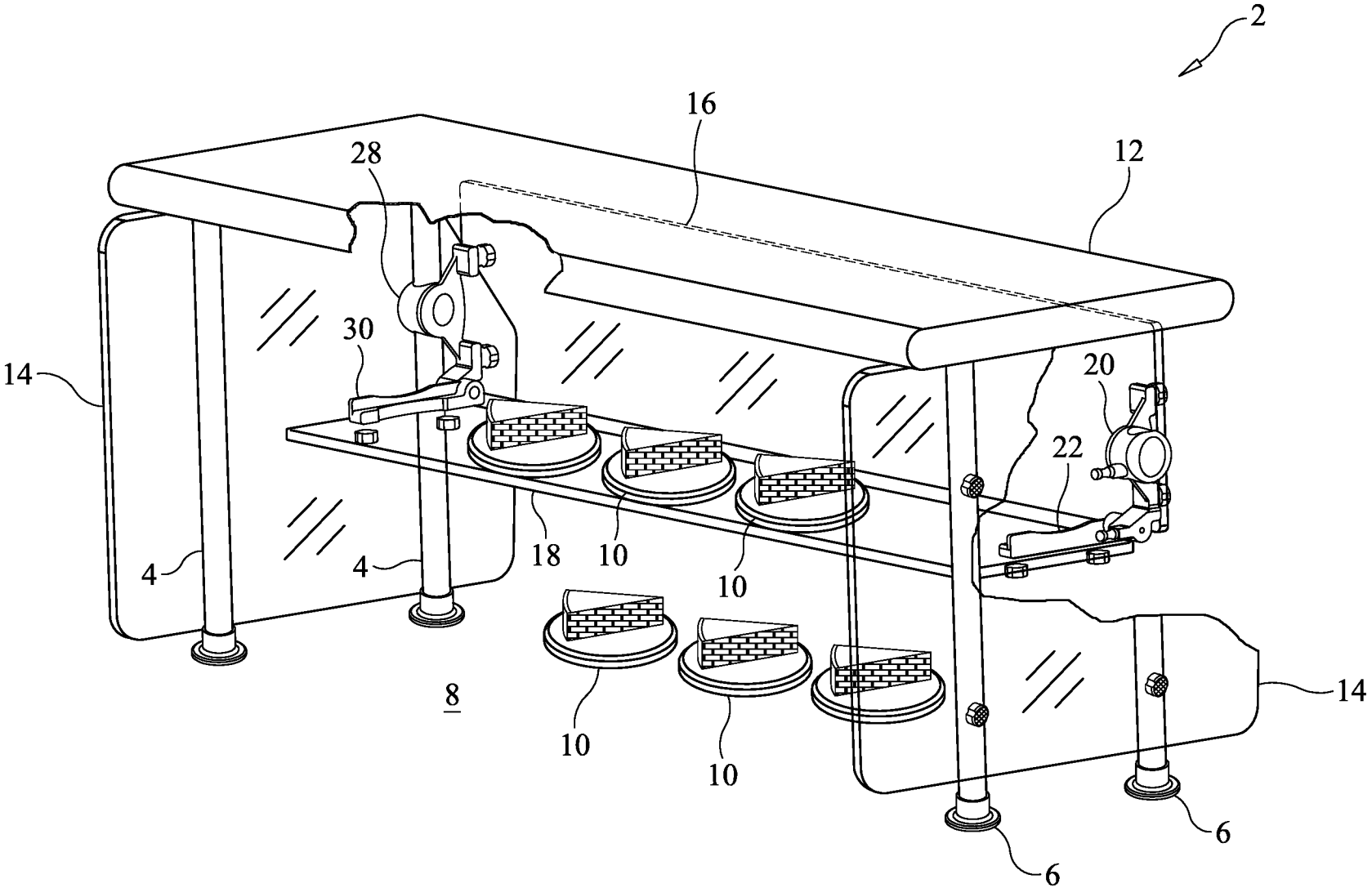
FIG. 6 is a rear perspective view of the food shield of the present invention in which the transparent panels thereof are adjusted to a combination self-serve and display setting.

In the self-serve mode, as shown in FIGS. 3 and 4 of the drawings, the lower transparent panel 18 may be folded behind with the upper transparent panel 16 so that food product 10 displayed is still visible through the panels 16, 18 and the customer or restaurant patron may reach under and help himself to the displayed food product 10, such as with a self-serve salad bar. The upper transparent panel 16 still provides a barrier to contamination from airborne bacteria transmitted by customers on the opposite side of the transparent panels 16, 18.

Advantageously, the food shield 2 of the present invention may be configured to operate in a combined self-serve/display mode. This is where the upper transparent panel 16 is angularly adjusted to prevent airborne bacteria transmitted by customers from reaching the displayed food product 10, and where the lower transparent panel 18 is angularly adjusted to a horizontal position, behind the upper transparent panel 16, so as to act as a shelf for displaying food product 10 thereon and behind the upper transparent panel 16. In this mode, the upper transparent panel 16 prevents contamination of the food 10 displayed on the lower transparent panel 18, and the displayed food 16 resting on the lower transparent panel 18, acting as a shelf, is more visible to the restaurant patron and may be used to provide a visual indication to the restaurant patron of the type or category of food product 10 being offered for consumption behind the food shield 2.

The food shield 2 of the present invention also advantageously allows the adjustment of the angular disposition of the upper and lower transparent panels 16, 18 to be effected from only one lateral side 24, 26 of the panels 16, 18. There is no need with the food shield 2 of the present invention to unlock the panel support mechanisms 20, 22, 28, 30 on both lateral sides 24, 32, 26, 34 of the upper and lower transparent panels 16, 18 simultaneously, as is required by many conventional food shields. One person may easily adjust the angular disposition of the food shield 2 of the present invention from only one lateral side 24, 26 of the transparent panels 16, 18.

Although it is described herein that the lower transparent panel 18 pivots inwardly on the food shield 2 with respect to the upper transparent panel 16, it may be possible and is envisioned to be within the scope of the present invention to reverse the positions of the panel support assembles 20, 22, 28, 30 so that they are on the outside of the transparent panels 16, 18 to allow the lower transparent panel 18 to pivot outwardly.

Furthermore, it is possible to interchange the non-locking lower panel support assembly 30 with the locking lower panel support assembly 22, or use two locking lower panel support assemblies 22 on each lateral side 26, 34 of the lower transparent panel 18. In other words, the non-locking lower panel support assembly 30 may be rotatably mounted on the locking upper panel support assembly 20, and the locking lower panel support assembly 22 may be rotatably mounted on the non-locking upper panel support assembly 28. Of course, with such an embodiment of the food shield 2, the user will lose the advantage of being able to adjust the angular dispositions of the upper and lower transparent panels 16, 18 from just one lateral side of the food shield 2.

Figure 12:
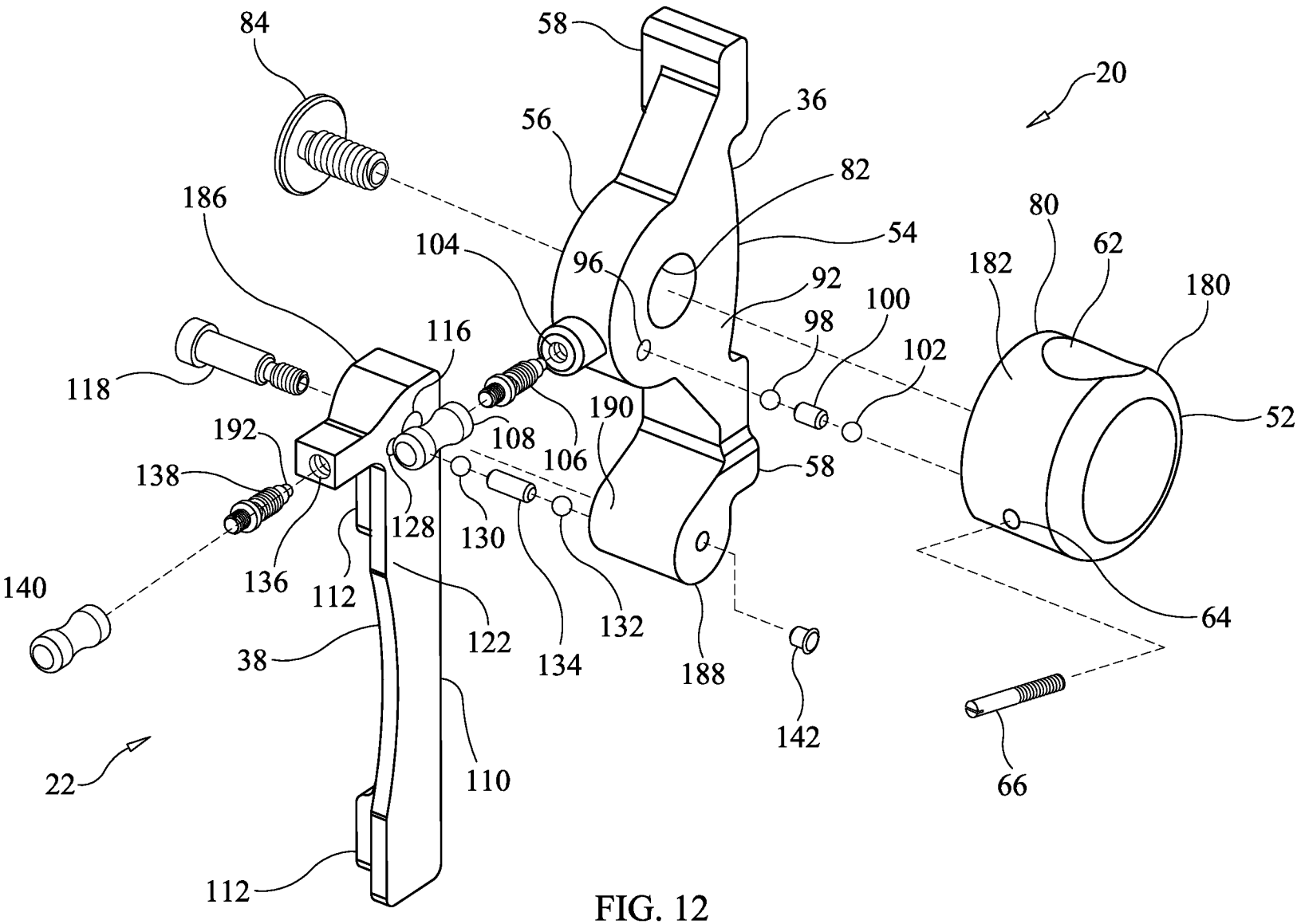
FIG. 12 is a right side, exploded perspective view of the first and second locking assemblies of the food shield constructed in accordance with a second form of the present invention.
Figure 13:
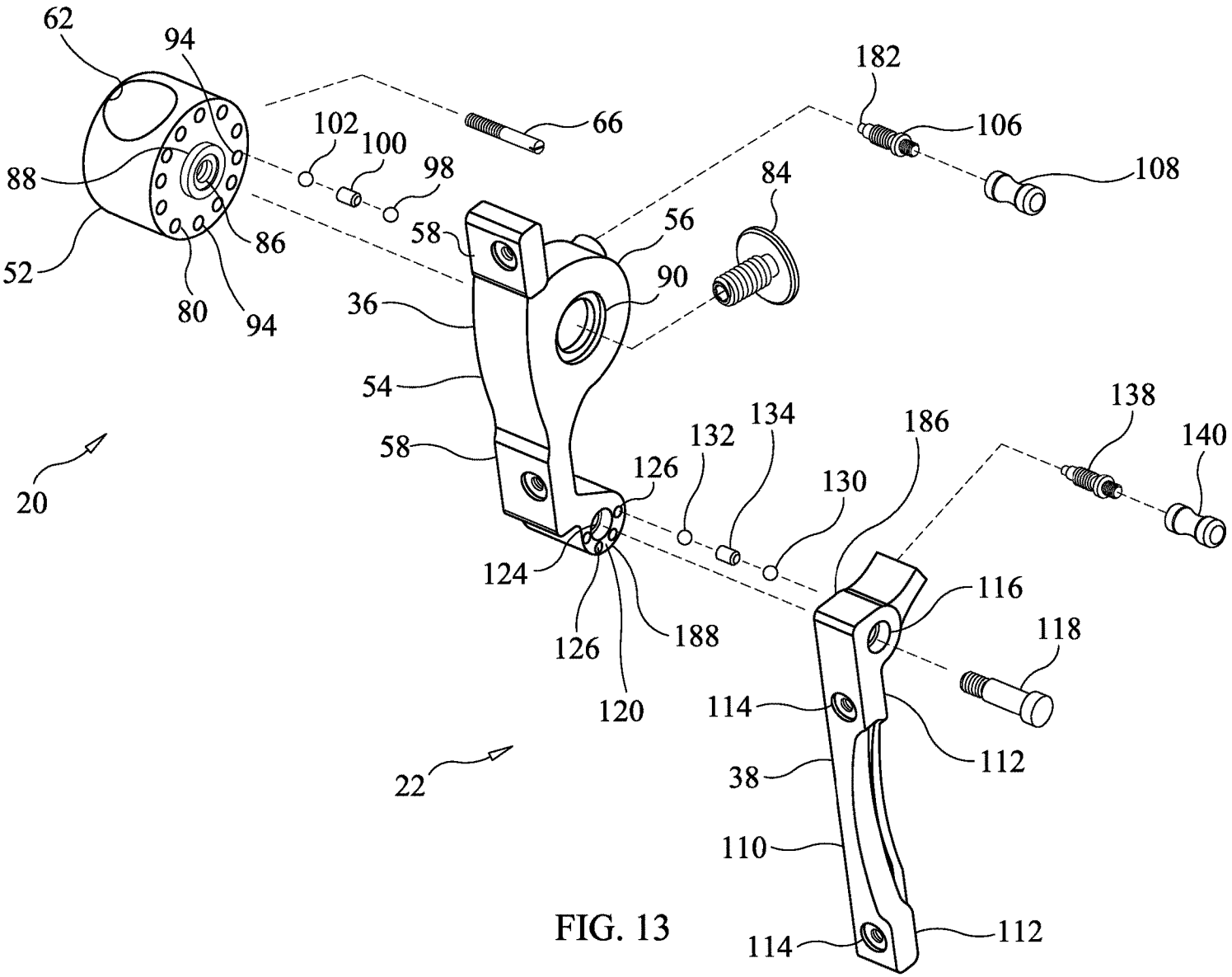
FIG. 13 is a left side, exploded perspective view of the first and second locking assemblies of the food shield constructed in accordance with a second form of the present invention and shown in FIG. 12.

In addition, and as shown in FIGS. 12 and 13, it is envisioned to be within the scope of the present invention to enlarge the thickness of the main body 54 and hub 56 of the upper panel support bracket 36 of the locking upper panel support assembly 20 so that the bore 96, having the two ball bearings 98, 102 and spacer rod 100 received thereby, may be formed in the surface of the lateral side 92 of the upper panel support bracket 36 instead of in the end face 80 of the locking chamber barrel 52, and further form the transverse direction bore 104, which receives the spring-biased plunger 106 having the attached knob 108, through the rear side of the main body 54 of the upper panel support bracket 36, instead of in the side wall of the locking chamber barrel 52.

Also, the plurality of spaced apart recesses 94 formed in the surface of the lateral side 92 of the upper panel support bracket 36 would instead be formed in the end face 80 of the locking chamber barrel 52. The cooperation between the components of the locking upper panel support assembly 20 described above in this alternative version of the food shield 2 will allow the upper transparent panel 16 to be adjusted and locked in a desired angular disposition in much the same way as with the other embodiments of the food shield 2 described herein.

Furthermore, with respect to the locking lower panel support assembly 22, and as also shown in FIGS. 12 and 13, the main body 110 of the lower panel support bracket 38 may be made to have a greater thickness laterally so that the bore 128, having the two ball bearings 130, 132 and spacer rod 134 received thereby, may be formed in the side wall 122 of the lower panel support bracket 38 instead of in the side wall 120 of the upper panel support bracket 36 of the locking upper panel support assembly 20, and further form the transverse direction bore 136, which receives the spring biased plunger 138 having the attached knob 140, through the rear side of the main body 110 of the lower panel support bracket 38 instead of in the rear side of the upper panel support bracket 36. Also, the recesses 126 formed in the surface of the side wall 122 of the lower panel support bracket 38 would instead be formed in the side wall 120 of the upper panel support bracket 36. The cooperation between the components of the locking lower panel support assembly 22 and the upper panel support bracket 36 described above in this alternative version of the food shield 2 will allow the lower transparent panel 18 to be adjusted and locked in a desired angular disposition in much the same way as with the other embodiments of the food shield 2 described herein.

To facilitate a full understanding of the present invention, the multi-positionable food shield disclosed previously herein will now be further described.

A multi-positionable folding food shield 2 configurable in different modes for use in a restaurant or food service institution includes an upper transparent panel 16 having a first lateral side portion 24 and a second lateral side portion 32 situated opposite the first lateral side portion 24, and further having a lower edge portion 168, an inner side 172 and an outer side 174 situated opposite the inner side 172. The folding food shield 2 also includes a first upper panel support assembly 20 for mounting on a first vertical support member 4, the first upper panel support assembly 20 being affixed to the first lateral side portion 24 of the upper transparent panel 16, and a second upper panel support assembly 28 for mounting on a second vertical support member 6, the second upper panel support assembly 28 being affixed to the second lateral side portion 32 of the upper transparent panel 16, the upper transparent panel 16 being positionable in different angular dispositions.

The folding food shield 2 further includes a lower transparent panel 18 having a first lateral side portion 26 and a second lateral side portion 34 situated opposite the first lateral side portion 26, and further having an upper edge portion 170, an inner side 176 and an outer side 178 situated opposite the inner side 176, a first lower panel support assembly 22 rotatably mounted on the first upper panel support assembly 20, the first lower panel support assembly 22 being affixed to the first lateral side portion 26 of the lower transparent panel 18, and a second lower panel support assembly 30 rotatably mounted on the second upper panel support assembly 28, the second lower panel support assembly 30 being affixed to the second lateral side portion 34 of the lower transparent panel 18, the lower transparent panel 18 being positionable in different angular dispositions. The upper transparent panel 16 is adjustable in a plurality of angular dispositions, and the lower transparent panel 18 is adjustable in at least two angular dispositions.

The food shield 2 is configurable in a cafeteria mode in which the lower transparent panel 18 is positionable relative to the upper transparent panel 16 such that the upper edge portion 168 of the lower transparent panel 18 overlaps the lower edge portion 170 of the upper transparent panel 16 and such that the upper transparent panel 16 and the lower transparent panel 18 together substantially define a barrier from airborne bacteria transmitted by patrons of the restaurant or food service institution in which the multi-positionable folding food shield 2 is used. The food shield 2 is also configurable in a self-serve mode in which the first and second lower panel support assemblies 22, 30 are rotated respectively on the first and second upper panel support assemblies 20, 28 to position the lower transparent panel 18 and the upper transparent panel 16 in a substantially folded state whereby the inner side 176 or the outer side 178 of the lower transparent panel 18 respectively faces the inner side 172 or the outer side 174 of the upper transparent panel 16.

Even more preferably, the lower transparent panel 18 of the multi-positionable folding food shield 2 is adjustable in at least three angular dispositions. Thus, the food shield 2 is further configurable in a self-serve and display mode in which the first and second lower panel support assemblies 22, 30 are rotated respectively on the first and second upper panel support assemblies 20, 28 to position the lower transparent panel 18 in a substantially horizontal disposition.

Preferably, the first upper panel support assembly 20 of the multi-positionable folding food shield 2 is a locking assembly which supports the first lateral side portion 24 of the upper transparent panel 16, allows the adjustment of the angular disposition of the upper transparent panel 16 and selectively locks the upper transparent panel 16 in one of the plurality of angular dispositions so that the angular disposition of the upper transparent panel 16 may be adjusted to and locked in one of the plurality of angular dispositions from only the first lateral side portion 24 of the upper transparent panel 16.

Also, preferably, the second upper panel support assembly 28 is a non-locking assembly which supports the second lateral side portion 32 of the upper transparent panel 16 and allows the adjustment of the angular disposition of the upper transparent panel 16 without locking the upper transparent panel 16 in one of the plurality of angular dispositions.

Furthermore, the first lower panel support assembly 22 preferably is a locking assembly which supports the first lateral side portion 26 of the lower transparent panel 18, allows the adjustment of the angular disposition of the lower transparent panel 18 and selectively locks the lower transparent panel 18 in one of the at least three angular dispositions so that the angular disposition of the lower transparent panel 18 may be adjusted to and locked in one of the at least three angular dispositions from only the first lateral side portion 26 of the lower transparent panel 18.

Additionally, in a preferred form, the second lower panel support assembly 30 is a non-locking assembly which supports the second lateral side portion 34 of the lower transparent panel 18 and allows the adjustment of the angular disposition of the lower transparent panel 18 without locking the lower transparent panel 18 in one of the at least three angular dispositions.

In another form of the present invention, the first upper panel support assembly 20 of the multi-positionable folding food shield 2 is a locking assembly which supports the first lateral side portion 24 of the upper transparent panel 16, allows the adjustment of the angular disposition of the upper transparent panel 16 and selectively locks the upper transparent panel 16 in one of the plurality of angular dispositions so that the angular disposition of the upper transparent panel 16 may be adjusted to and locked in one of the plurality of angular dispositions from only the first lateral side portion 24 of the upper transparent panel 16. Furthermore, in this embodiment, the second upper panel support assembly 28 is a non-locking assembly which supports the second lateral side portion 32 of the upper transparent panel 16 and allows the adjustment of the angular disposition of the upper transparent panel 16 without locking the upper transparent panel 16 in one of the plurality of angular dispositions. Additionally, the second lower panel support assembly 30 is a locking assembly which supports the second lateral side portion 34 of the lower transparent panel 18, allows the adjustment of the angular disposition of the lower transparent panel 18 and selectively locks the lower transparent panel 18 in one of the at least three angular dispositions so that the angular disposition of the lower transparent panel 18 may be adjusted to and locked in one of the at least three angular dispositions from only the second lateral side portion 34 of the lower transparent panel 18. Furthermore, in this version of the food shield 2, the first lower panel support assembly 22 is a non-locking assembly which supports the first lateral side portion 26 of the lower transparent panel 18 and allows the adjustment of the angular disposition of the lower transparent panel 18 without locking the lower transparent panel 18 in one of the at least three angular dispositions.

In another form of the present invention, the first upper panel support assembly 20 of the multi-positionable folding food shield 2 is a locking assembly which supports the first lateral side portion 24 of the upper transparent panel 16, allows the adjustment of the angular disposition of the upper transparent panel 16 and selectively locks the upper transparent panel 16 in one of the plurality of angular dispositions so that the angular disposition of the upper transparent panel 16 may be adjusted to and locked in one of the plurality of angular dispositions from only the first lateral side portion 24 of the upper transparent panel 16. Additionally, in this embodiment, the second upper panel support assembly 28 is a non-locking assembly which supports the second lateral side portion 32 of the upper transparent panel 16 and allows the adjustment of the angular disposition of the upper transparent panel 16 without locking the upper transparent panel 16 in one of the plurality of angular dispositions. Furthermore, the second lower panel support assembly 30 of this food shield 2 is a locking assembly which supports the second lateral side portion 34 of the lower transparent panel 18, allows the adjustment of the angular disposition of the lower transparent panel 18 and selectively locks the lower transparent panel 18 in one of the at least two angular dispositions so that the angular disposition of the lower transparent panel 18 may be adjusted to and locked in one of the at least two angular dispositions from only the second lateral side portion 34 of the lower transparent panel 18. Also, in this version of the food shield of the present invention, the first lower panel support assembly 22 is a non-locking assembly which supports the first lateral side portion 26 of the lower transparent panel 18 and allows the adjustment of the angular disposition of the lower transparent panel 18 without locking the lower transparent panel 18 in one of the at least two angular dispositions.

In yet another embodiment of the present invention, the first upper panel support assembly 20 of the multi-positionable folding food shield 2 is a locking assembly which supports the first lateral side portion 24 of the upper transparent panel 16, allows the adjustment of the angular disposition of the upper transparent panel 16 and selectively locks the upper transparent panel 16 in one of the plurality of angular dispositions so that the angular disposition of the upper transparent panel 16 may be adjusted to and locked in one of the plurality of angular dispositions from only the first lateral side portion 24 of the upper transparent panel 16. Furthermore, in this embodiment, the second upper panel support assembly 28 is a non-locking assembly which supports the second lateral side portion 32 of the upper transparent panel 16 and allows the adjustment of the angular disposition of the upper transparent panel 16 without locking the upper transparent panel 16 in one of the plurality of angular dispositions. Additionally, the first lower panel support assembly 22 of this embodiment of the food shield 2 is a locking assembly which supports the first lateral side portion 26 of the lower transparent panel 18, allows the adjustment of the angular disposition of the lower transparent panel 18 and selectively locks the lower transparent panel 18 in one of the at least two angular dispositions so that the angular disposition of the lower transparent panel 18 may be adjusted to and locked in one of the at least two angular dispositions from only the first lateral side portion 26 of the lower transparent panel 16. Also, the second lower panel support assembly 30 is a non-locking assembly which supports the second lateral side portion 34 of the lower transparent panel 18 and allows the adjustment of the angular disposition of the lower transparent panel 18 without locking the lower transparent panel 18 in one of the at least two angular dispositions.

Preferably, the first upper panel support assembly 20 of the multi-positionable folding food shield 2 of the present invention includes a first upper panel support bracket 36 on which the first lateral side portion 24 of the upper transparent panel 16 is mounted, the first upper panel support bracket 36 including a lateral side 92 having a surface in which is formed a plurality of spaced apart recesses 94 arranged in a circle.

The first upper panel support assembly 20 also preferably includes a locking chamber barrel 52. The locking chamber barrel 52 has a barrel body 180, a side wall 182 and an end face 80 which faces the lateral side surface 92 of the first upper panel support bracket 36 in which is formed the plurality of recesses 94. The first upper panel support bracket 36 is rotatably mounted to the locking chamber barrel 52, the locking chamber barrel 52 having a first bore 96 formed in the end face 80 thereof and extending in an axial direction into the barrel body 180. The first bore 96 is situated to be in alignment with one of the plurality of spaced apart recesses 94 formed in the surface of the lateral side 92 of the first upper panel support bracket 36. The locking chamber barrel 52 further has a second bore 104 formed in the side wall 182 thereof and extending in a direction transverse to the direction in which the first bore 96 extends and to meet the first bore 96, the second bore 104 being in communication with the first bore 96.

The first upper panel support assembly 20 also preferably includes a first plunger 106 mounted in the second, transverse bore 104. The first plunger 106 has an inner axial tip 184 and an outer axial end 108 disposed opposite the inner axial tip 184 and operatively joined to the inner axial tip 184. The inner axial tip 184 is movable between a first position in which the tip 184 extends into the first bore 96 where the second bore 104 meets the first bore 96, and a second position in which the tip 184 does not extend into the first bore 96. The outer axial end 108 of the first plunger 106 is graspable by a user of the food shield 2 to effect movement of the inner axial tip 184 of the first plunger 106 between the first position and the second position.

Furthermore, the first upper panel support assembly 20 includes at least one first displaceable member 98, 100, 102 situated within the first bore 96. The at least one first displaceable member 98, 100, 102 is reciprocatingly movable within the first bore 96 between a first state in which the at least one first displaceable member 98, 100, 102 is operatively forced by the first plunger 106 to be at least partially received in one of the plurality of recesses 94 formed in the surface of the lateral side 92 of the first upper panel support bracket 36 when the inner axial tip 184 of the first plunger 106 is in the first position, and a second state in which the at least one first displaceable member 98, 100, 102 is not operatively forced by the first plunger 106 to be at least partially received in one of the plurality of recesses 94 formed in the surface of the lateral side 92 of the first upper panel support bracket 36 when the inner axial tip 184 of the first plunger 106 is in the second position.

The at least one first displaceable member 98, 100, 102 may be a single member or more than one member contacting one another. Preferably, the at least one first displaceable member includes an inner member 98, an outer member 102 and an intermediary spacer member 100 interposed between the inner member 98 and the outer member 102. The inner member 98, intermediary spacer member 100 and the outer member 102 are situated within the first bore 96 of the locking chamber barrel 52. The inner member 98 is positioned in the first bore 96 of the locking chamber barrel 52 distally relative to the end face 80 of the locking chamber barrel 52, and the outer member 102 is positioned in the first bore 96 of the locking chamber barrel 52 proximally relative to the end face 80 of the locking chamber barrel 52. Preferably, the inner axial tip 184 of the first plunger 106 engages the inner member 98 when the inner axial tip 184 is in the first position and forces the inner member 98, the intermediary spacer member 100 and the outer member 102 to move outwardly within the first bore 96 of the locking chamber barrel 52 in a direction towards the end face 80 of the locking chamber barrel 52 such that the outer member 102 is at least partially received by one of the plurality of recesses 94 formed in the surface of the lateral side 92 of the first upper panel support bracket 36 to prevent relative movement between the first upper panel support bracket 36 and the locking chamber barrel 52 and to thereby lock the upper transparent panel 16 in a desired angular disposition. Even more preferably, the inner member 98 is in the form of a first ball bearing, the intermediary spacer member 100 is in the form of a cylindrical rod, and the outer member 102 is in the form of a second ball bearing.

In a preferred form of the multi-positionable folding food shield 2 of the present invention, the first lower panel support assembly 22 includes a first lower panel support bracket 38 on which the first lateral side portion 26 of the lower transparent panel 18 is mounted, the first lower panel support bracket 26 including a lateral side wall 122 in which is formed at least two spaced apart recesses 126, the first lower panel support bracket 38 having an upper portion 186. The first upper panel support bracket 36 includes a lower portion 188, the upper portion 186 of the first lower panel support bracket 38 being rotatably mounted on the lower portion 188 of the first upper panel support bracket 36.

Furthermore, the lower portion 188 of the first upper panel support bracket 36 includes a lateral side wall 120 which faces the lateral side wall 122 of the first lower panel support bracket 38 in which is formed the at least two spaced apart recesses 126, and further includes a transverse wall 190 situated transversely to the lateral side wall 120 of the lower portion 188 of the first upper panel support bracket 36.

Preferably, a third bore 128 is formed in the lateral side wall 120 of the lower portion 188 of the first upper panel support bracket 36 and extending in a lateral direction into the lower portion 188 of the first upper panel support bracket 36. The third bore 128 is situated to be in alignment with one of the at least two spaced apart recesses 126 formed in the lateral side wall 122 of the first lower panel support bracket 38. The lower portion 188 of the first upper panel support bracket 36 further has a fourth bore 136 formed in the transverse wall 190 thereof and extending in a direction transverse to the direction in which the third bore 128 extends and to meet the third bore 128, the fourth bore 136 being in communication with the third bore 128.

Additionally, there is a second plunger 138 which is mounted in the fourth, transverse bore 136. The second plunger 138 has an inner axial tip 192 and an outer axial end 140 disposed opposite the inner axial tip 192 and operatively joined to the inner axial tip 192. The inner axial tip 192 of the second plunger 138 is movable between a first position in which the tip 192 extends into the third bore 128 where the fourth bore 136 meets the third bore 128, and a second position in which the tip 192 does not extend into the third bore 128. The outer axial end 140 of the second plunger 138 is graspable by a user of the food shield 2 to effect movement of the inner axial tip 192 of the second plunger 138 between the first position and the second position.

There is further at least one second displaceable member 130, 132, 134 situated within the third bore 128. The at least one second displaceable member 130, 132, 134 is reciprocatingly movable within the third bore 128 between a first state in which the at least one second displaceable member 130, 132, 134 is operatively forced by the second plunger 138 to be at least partially received in one of the at least two recesses 126 formed in the lateral side wall 122 of the first lower panel support bracket 38 when the inner actual tip 192 of the second plunger 138 is in the first position, and a second state in which the at least one second displaceable member 130, 132, 134 is not operatively forced by the second plunger 138 to be at least partially received in one of the at least two recesses 126 formed in the lateral side wall 122 of the first lower panel support bracket 38 when the inner axial tip 192 of the second plunger 138 is in the second position.

The at least one second displaceable member 130, 132, 134 may be a single member or more than one member contacting one another. Preferably, the at least one second displaceable member includes an inner member 130, an outer member 132 and an intermediary spacer member 134 interposed between the inner member 130 and the outer member 132. The inner member 130, intermediary spacer member 134 and the outer member 132 are situated within the third bore 128 formed in the lateral side wall 120 of the lower portion 188 of the first upper panel support bracket 36. The inner member 130 is positioned in the third bore 128 of the first upper panel support bracket 36 distally relative to the surface of the lateral side wall 120 of the lower portion 188 of the first upper panel support bracket 36, and the outer member 132 is positioned in the third bore 128 of the first upper panel support bracket 36 proximally relative to the surface of the lateral side wall 120 of the lower portion 188 of the first upper panel support bracket 36. Preferably, the inner axial tip 192 of the second plunger 138 engages the inner member 130 when the inner axial tip 192 is in the first position and forces the inner member 130, the intermediary spacer member 134 and the outer member 132 to move outwardly within the third bore 128 of the lower portion 188 of the first upper panel support bracket 36 in a direction towards the surface of the lateral side wall 120 of the lower portion 188 of the first upper panel support bracket 36 such that the outer member 132 is at least partially received by one of the at least two spaced apart recesses 126 formed in the lateral side wall 122 of the first lower panel support bracket 38 to prevent relative movement between the first upper panel support bracket 36 of the first upper panel support assembly 20 and the first lower panel support bracket 38 of the first lower panel support assembly 22 and to thereby lock the lower transparent panel 18 in a desired angular disposition. Even more preferably, the inner member 130 of the at least one second displaceable member is in the form of a first ball bearing, the intermediary spacer member 134 of the at least one second displaceable member is in the form of a cylindrical rod, and the outer member 132 of the at least one second displaceable member is in the form of a second ball bearing.

In another preferred form of the present invention, the locking chamber barrel 52 of the first upper panel support assembly 20 of the multi-positionable folding food shield 2 includes a third bore 62 formed diametrically therethrough for receiving the first vertical support member 4 and for mounting the first upper panel support assembly 20 on the first vertical support member 4.

In yet another form, the first lower panel support assembly 22 of the multi-positionable folding food shield 2 is mounted on the first upper panel support assembly 20 and is movable therewith. Furthermore, the second lower panel support assembly 30 is mounted on the second upper panel support assembly 28 and is movable therewith. Thus, adjustment of the upper transparent panel 16 to a desired angular disposition will cause a corresponding angular adjustment of the disposition of the lower transparent panel 18 while maintaining the relative angular disposition between the upper transparent panel 16 and the lower transparent panel 18.

In another preferred form of the present invention, the second upper panel support assembly 28 of the multi-positionable folding food shield 2 includes a second upper panel support bracket 40 on which the second lateral side portion 32 of the upper transparent panel 16 is mounted, and a non-locking chamber barrel 68, the second upper panel support bracket 40 being mounted on the non-locking chamber barrel 68 and being rotatable relative thereto.

Preferably, the non-locking chamber barrel 62 of the second upper panel support assembly 28 has an end face 150, the end face 150 having at least a partial first bore 148 formed centrally therein. The second upper panel support bracket 40 of the second upper panel support assembly 28 includes a generally planar main body portion 70, the planar main body portion 70 being situated in proximity to the end face 150 of the non-locking chamber barrel 62, the planar main body portion 70 of the second upper panel support bracket 40 having an opening 144 formed through the thickness thereof, the opening 144 in the second upper panel support bracket 40 being situated in alignment with the at least partial first bore 148 formed in the end face 150 of the non-locking chamber barrel 68. The second upper panel support assembly 28 preferably further includes a fastener 146 for fastening together the second upper panel support bracket 40 and the non-locking chamber barrel 68, the fastener 146 passing through the opening 144 of the second upper panel support bracket 40 and being at least partially received by the at least partial first bore 148 of the non-locking chamber barrel 68.

Even more preferably, the non-locking chamber barrel 68 of the second upper panel support assembly 28 includes a second bore 76 formed diametrically therethrough for receiving the second vertical support member 6 and for mounting the second upper panel support assembly 28 on the second vertical support member 6.

In another preferred form of the multi-positionable folding food shield 2 of the present invention, the second lower panel support assembly 30 includes a second lower panel support bracket 42 on which the second lateral side portion 34 of the lower transparent panel 18 is mounted, the second lower panel support bracket 42 having an upper portion 194. The second upper panel support bracket 40 includes a lower portion 196, the upper portion 194 of the second lower panel support bracket 42 being rotatably mounted on the lower portion 196 of the second upper panel support bracket 40.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A multi-positionable folding food shield configurable in different modes for use in a restaurant or food service institution, which comprises:

an upper transparent panel having a first lateral side portion and a second lateral side portion situated opposite the first lateral side portion, and further having a lower edge portion, an inner side and an outer side situated opposite the inner side;

a first upper panel support assembly for mounting on a first vertical support member, the first upper panel support assembly being affixed to the first lateral side portion of the upper transparent panel;

a second upper panel support assembly for mounting on a second vertical support member, the second upper panel support assembly being affixed to the second lateral side portion of the upper transparent panel, the upper transparent panel being positionable in different angular dispositions;

a lower transparent panel having a first lateral side portion and a second lateral side portion situated opposite the first lateral side portion, and further having an upper edge portion, an inner side and an outer side situated opposite the inner side;

a first lower panel support assembly rotatably mounted on the first upper panel support assembly, the first lower panel support assembly being affixed to the first lateral side portion of the lower transparent panel; and a second lower panel support assembly rotatably mounted on the second upper panel support assembly, the second lower panel support assembly being affixed to the second lateral side portion of the lower transparent panel, the lower transparent panel being positionable in different angular dispositions;

wherein the upper transparent panel is adjustable in a plurality of angular dispositions;

wherein the lower transparent panel is adjustable in at least two angular dispositions;

wherein the food shield is configurable in a cafeteria mode in which the lower transparent panel is positionable relative to the upper transparent panel such that the upper edge portion of the lower transparent panel overlaps the lower edge portion of the upper transparent panel and such that the upper transparent panel and the lower transparent panel together substantially define a barrier from airborne bacteria transmitted by patrons of the restaurant or food service institution in which the multi-positionable folding food shield is used; and wherein the food shield is configurable in a self-serve mode in which the first and second lower panel support assemblies are rotated respectively on the first and second upper panel support assemblies to position the lower transparent panel and the upper transparent panel in a substantially folded state whereby the inner side or the outer side of the lower transparent panel respectively faces the inner side or the outer side of the upper transparent panel.

2. A multi-positionable folding food shield as defined by claim 1, wherein the lower transparent panel is adjustable in at least three angular dispositions; and wherein the food shield is further configurable in a self-serve and display mode in which the first and second lower panel support assemblies are rotated respectively on the first and second upper panel support assemblies to position the lower transparent panel in a substantially horizontal disposition.

3. A multi-positionable folding food shield as defined by claim 2, wherein the first upper panel support assembly is a locking assembly which supports the first lateral side portion of the upper transparent panel, allows the adjustment of the angular disposition of the upper transparent panel and selectively locks the upper transparent panel in one of the plurality of angular dispositions so that the angular disposition of the upper transparent panel may be adjusted to and locked in one of the plurality of angular dispositions from only the first lateral side portion of the upper transparent panel;

wherein the second upper panel support assembly is a non-locking assembly which supports the second lateral side portion of the upper transparent panel and allows the adjustment of the angular disposition of the upper transparent panel without locking the upper transparent panel in one of the plurality of angular dispositions;

wherein the first lower panel support assembly is a locking assembly which supports the first lateral side portion of the lower transparent panel, allows the adjustment of the angular disposition of the lower transparent panel and selectively locks the lower transparent panel in one of the at least three angular dispositions so that the angular disposition of the lower transparent panel may be adjusted to and locked in one of the at least three angular dispositions from only the first lateral side portion of the lower transparent panel; and wherein the second lower panel support assembly is a non-locking assembly which supports the second lateral side portion of the lower transparent panel and allows the adjustment of the angular disposition of the lower transparent panel without locking the lower transparent panel in one of the at least three angular dispositions.

4. A multi-positionable folding food shield as defined by claim 2, wherein the first upper panel support assembly is a locking assembly which supports the first lateral side portion of the upper transparent panel, allows the adjustment of the angular disposition of the upper transparent panel and selectively locks the upper transparent panel in one of the plurality of angular dispositions so that the angular disposition of the upper transparent panel may be adjusted to and locked in one of the plurality of angular dispositions from only the first lateral side portion of the upper transparent panel;

wherein the second upper panel support assembly is a non-locking assembly which supports the second lateral side portion of the upper transparent panel and allows the adjustment of the angular disposition of the upper transparent panel without locking the upper transparent panel in one of the plurality of angular dispositions;

wherein the second lower panel support assembly is a locking assembly which supports the second lateral side portion of the lower transparent panel, allows the adjustment of the angular disposition of the lower transparent panel and selectively locks the lower transparent panel in one of the at least three angular dispositions so that the angular disposition of the lower transparent panel may be adjusted to and locked in one of the at least three angular dispositions from only the second lateral side portion of the lower transparent panel; and wherein the first lower panel support assembly is a non-locking assembly which supports the first lateral side portion of the lower transparent panel and allows the adjustment of the angular disposition of the lower transparent panel without locking the lower transparent panel in one of the at least three angular dispositions.

5. A multi-positionable folding food shield as defined by claim 1, wherein the first upper panel support assembly is a locking assembly which supports the first lateral side portion of the upper transparent panel, allows the adjustment of the angular disposition of the upper transparent panel and selectively locks the upper transparent panel in one of the plurality of angular dispositions so that the angular disposition of the upper transparent panel may be adjusted to and locked in one of the plurality of angular dispositions from only the first lateral side portion of the upper transparent panel;

wherein the second upper panel support assembly is a non-locking assembly which supports the second lateral side portion of the upper transparent panel and allows the adjustment of the angular disposition of the upper transparent panel without locking the upper transparent panel in one of the plurality of angular dispositions;

wherein the second lower panel support assembly is a locking assembly which supports the second lateral side portion of the lower transparent panel, allows the adjustment of the angular disposition of the lower transparent panel and selectively locks the lower transparent panel in one of the at least two angular dispositions so that the angular disposition of the lower transparent panel may be adjusted to and locked in one of the at least two angular dispositions from only the second lateral side portion of the lower transparent panel; and wherein the first lower panel support assembly is a non-locking assembly which supports the first lateral side portion of the lower transparent panel and allows the adjustment of the angular disposition of the lower transparent panel without locking the lower transparent panel in one of the at least two angular dispositions.

6. A multi-positionable folding food shield as defined by claim 1, wherein the first upper panel support assembly is a locking assembly which supports the first lateral side portion of the upper transparent panel, allows the adjustment of the angular disposition of the upper transparent panel and selectively locks the upper transparent panel in one of the plurality of angular dispositions so that the angular disposition of the upper transparent panel may be adjusted to and locked in one of the plurality of angular dispositions from only the first lateral side portion of the upper transparent panel;

wherein the second upper panel support assembly is a non-locking assembly which supports the second lateral side portion of the upper transparent panel and allows the adjustment of the angular disposition of the upper transparent panel without locking the upper transparent panel in one of the plurality of angular dispositions;

wherein the first lower panel support assembly is a locking assembly which supports the first lateral side portion of the lower transparent panel, allows the adjustment of the angular disposition of the lower transparent panel and selectively locks the lower transparent panel in one of the at least two angular dispositions so that the angular disposition of the lower transparent panel may be adjusted to and locked in one of the at least two angular dispositions from only the first lateral side portion of the lower transparent panel; and wherein the second lower panel support assembly is a non-locking assembly which supports the second lateral side portion of the lower transparent panel and allows the adjustment of the angular disposition of the lower transparent panel without locking the lower transparent panel in one of the at least two angular dispositions.

7. A multi-positionable folding food shield as defined by claim 6, wherein the first upper panel support assembly includes:

a first upper panel support bracket on which the first lateral side portion of the upper transparent panel is mounted, the first upper panel support bracket including a lateral side having a surface in which is formed a plurality of spaced apart recesses arranged in a circle;

a locking chamber barrel, the locking chamber barrel having a barrel body, a side wall and an end face which faces the lateral side surface of the first upper panel support bracket in which is formed the plurality of recesses, the first upper panel support bracket being rotatably mounted to the locking chamber barrel, the locking chamber barrel having a first bore formed in the end face thereof and extending in an axial direction into the barrel body, the first bore being situated to be in alignment with one of the plurality of spaced apart recesses formed in the surface of the lateral side of the first upper panel support bracket, the locking chamber barrel further having a second bore formed in the side wall thereof and extending in a direction transverse to the direction in which the first bore extends and to meet the first bore, the second bore being in communication with the first bore;

a first plunger mounted in the second, transverse bore, the first plunger having an inner axial tip and an outer axial end disposed opposite the inner axial tip and operatively joined to the inner axial tip, the inner axial tip being movable between a first position in which the tip extends into the first bore where the second bore meets the first bore, and a second position in which the tip does not extend into the first bore, the outer axial end of the first plunger being graspable by a user of the food shield to effect movement of the inner axial tip of the first plunger between the first position and the second position; and at least one first displaceable member situated within the first bore, the at least one first displaceable member being reciprocatingly movable within the first bore between a first state in which the at least one first displaceable member is operatively forced by the first plunger to be at least partially received in one of the plurality of recesses formed in the surface of the lateral side of the first upper panel support bracket when the inner axial tip of the first plunger is in the first position, and a second state in which the at least one first displaceable member is not operatively forced by the first plunger to be at least partially received in one of the plurality of recesses formed in the surface of the lateral side of the first upper panel support bracket when the inner axial tip of the first plunger is in the second position.

8. A multi-positionable folding food shield as defined by claim 7, wherein the at least one first displaceable member includes an inner member, an outer member and an intermediary spacer member interposed between the inner member and the outer member, the inner member, intermediary spacer member and the outer member being situated within the first bore of the locking chamber barrel, the inner member being positioned in the first bore of the locking chamber barrel distally relative to the end face of the locking chamber barrel, and the outer member being positioned in the first bore of the locking chamber barrel proximally relative to the end face of the locking chamber barrel;

wherein the inner axial tip of the first plunger engages the inner member when the inner axial tip is in the first position and forces the inner member, the intermediary spacer member and the outer member to move outwardly within the first bore of the locking chamber barrel in a direction towards the end face of the locking chamber barrel such that the outer member is at least partially received by one of the plurality of recesses formed in the surface of the lateral side of the first upper panel support bracket to prevent relative movement between the first upper panel support bracket and the locking chamber barrel and to thereby lock the upper transparent panel in a desired angular disposition.

9. A multi-positionable folding food shield as defined by claim 8, wherein the inner member is in the form of a first ball bearing, the intermediary spacer member is in the form of a cylindrical rod, and the outer member is in the form of a second ball bearing.

10. A multi-positionable folding food shield as defined by claim 7, wherein the first lower panel support assembly includes:

a first lower panel support bracket on which the first lateral side portion of the lower transparent panel is mounted, the first lower panel support bracket including a lateral side wall in which is formed at least two spaced apart recesses, the first lower panel support bracket having an upper portion;

wherein the first upper panel support bracket includes a lower portion, the upper portion of the first lower panel support bracket being rotatably mounted on the lower portion of the first upper panel support bracket;

wherein the lower portion of the first upper panel support bracket includes a lateral side wall which faces the lateral side wall of the first lower panel support bracket in which is formed the at least two spaced apart recesses, and further includes a transverse wall situated transversely to the lateral side wall of the lower portion of the first upper panel support bracket;

wherein a third bore is formed in the lateral side wall of the lower portion of the first upper panel support bracket and extending in a lateral direction into the lower portion of the first upper panel support bracket, the third bore being situated to be in alignment with one of the at least two spaced apart recesses formed in the lateral side wall of the first lower panel support bracket, the lower portion of the first upper panel support bracket further having a fourth bore formed in the transverse wall thereof and extending in a direction transverse to the direction in which the third bore extends and to meet the third bore, the fourth bore being in communication with the third bore;

a second plunger mounted in the fourth, transverse bore, the second plunger having an inner axial tip and an outer axial end disposed opposite the inner axial tip and operatively joined to the inner axial tip, the inner axial tip of the second plunger being movable between a first position in which the tip extends into the third bore where the fourth bore meets the third bore, and a second position in which the tip does not extend into the third bore, the outer axial end of the second plunger being graspable by a user of the food shield to effect movement of the inner axial tip of the second plunger between the first position and the second position; and at least one second displaceable member situated within the third bore, the at least one second displaceable member being reciprocatingly movable within the third bore between a first state in which the at least one second displaceable member is operatively forced by the second plunger to be at least partially received in one of the at least two recesses formed in the lateral side wall of the first lower panel support bracket when the inner actual tip of the second plunger is in the first position, and a second state in which the at least one second displaceable member is not operatively forced by the second plunger to be at least partially received in one of the at least two recesses formed in the lateral side wall of the first lower panel support bracket when the inner axial tip of the second plunger is in the second position.

11. A multi-positionable folding food shield as defined by claim 10, wherein the at least one second displaceable member includes an inner member, an outer member and an intermediary spacer member interposed between the inner member and the outer member, the inner member, intermediary spacer member and the outer member being situated within the third bore formed in the lateral side wall of the lower portion of the first upper panel support bracket, the inner member being positioned in the third bore of the first upper panel support bracket distally relative to the lateral side wall of the lower portion of the first upper panel support bracket, and the outer member being positioned in the third bore of the first upper panel support bracket proximally relative to the lateral side wall of the lower portion of the first upper panel support bracket;

wherein the inner axial tip of the second plunger engages the inner member when the inner axial tip is in the first position and forces the inner member, the intermediary spacer member and the outer member to move outwardly within the third bore of the lower portion of the first upper panel support bracket in a direction towards the lateral side wall of the lower portion of the first upper panel support bracket such that the outer member is at least partially received by one of the at least two spaced apart recesses formed in the lateral side wall of the first lower panel support bracket to prevent relative movement between the first upper panel support bracket of the first upper panel support assembly and the first lower panel support bracket of the first lower panel support assembly and to thereby lock the lower transparent panel in a desired angular disposition.

12. A multi-positionable folding food shield as defined by claim 11, wherein the inner member of the at least one second displaceable member is in the form of a first ball bearing, the intermediary spacer member of the at least one second displaceable member is in the form of a cylindrical rod, and the outer member of the at least one second displaceable member is in the form of a second ball bearing.

13. A multi-positionable folding food shield as defined by claim 7, wherein the locking chamber barrel of the first upper panel support assembly includes a third bore formed diametrically therethrough for receiving the first vertical support member and for mounting the first upper panel support assembly on the first vertical support member.

14. A multi-positionable folding food shield as defined by claim 6, wherein the first lower panel support assembly being mounted on the first upper panel support assembly is movable therewith, and wherein the second lower panel support assembly being mounted on the second upper panel support assembly is movable therewith, whereby adjustment of the upper transparent panel to a desired angular disposition will cause a corresponding angular adjustment of the disposition of the lower transparent panel while maintaining the relative angular disposition between the upper transparent panel and the lower transparent panel.

15. A multi-positionable folding food shield as defined by claim 6, wherein the second upper panel support assembly includes:

a second upper panel support bracket on which the second lateral side portion of the upper transparent panel is mounted; and a non-locking chamber barrel, the second upper panel support bracket being mounted on the non-locking chamber barrel and being rotatable relative thereto.

16. A multi-positionable folding food shield as defined by claim 15, wherein the non-locking chamber barrel of the second upper panel support assembly has an end face, the end face having at least a partial first bore formed centrally therein;

wherein the second upper panel support bracket of the second upper panel support assembly includes a generally planar main body portion, the planar main body portion being situated in proximity to the end face of the non-locking chamber barrel, the planar main body portion of the second upper panel support bracket having an opening formed through the thickness thereof, the opening in the second upper panel support bracket being situated in alignment with the at least partial first bore formed in the end face of the non-locking chamber barrel; and wherein the second upper panel support assembly further includes a fastener for fastening together the second upper panel support bracket and the non-locking chamber barrel, the fastener passing through the opening of the second upper panel support bracket and being at least partially received by the at least partial first bore of the non-locking chamber barrel.

17. A multi-positionable folding food shield as defined by claim 16, wherein the non-locking chamber barrel of the second upper panel support assembly includes a second bore formed diametrically therethrough for receiving the second vertical support member and for mounting the second upper panel support assembly on the second vertical support member.

18. A multi-positionable folding food shield as defined by claim 15, wherein the second lower panel support assembly includes:

a second lower panel support bracket on which the second lateral side portion of the lower transparent panel is mounted, the second lower panel support bracket having an upper portion;

wherein the second upper panel support bracket includes a lower portion, the upper portion of the second lower panel support bracket being rotatably mounted on the lower portion of the second upper panel support bracket.

19. A multi-positionable folding food shield as defined by claim 1, wherein at least one of the first upper panel support assembly and the second upper panel support assembly includes a locking assembly which supports one of the first lateral side portion and the second lateral side portion of the upper transparent panel, allows the adjustment of the angular disposition of the upper transparent panel and selectively locks the upper transparent panel in one of the plurality of angular dispositions so that the angular disposition of the upper transparent panel may be adjusted to and locked in one of the plurality of angular dispositions from at least one of the first lateral side portion and the second lateral side portion of the upper transparent panel; and wherein at least one of the first lower panel support assembly and the second lower panel support assembly includes a locking assembly which supports one of the first lateral side portion and the second lateral side portion of the lower transparent panel, allows the adjustment of the angular disposition of the lower transparent panel and selectively locks the lower transparent panel in one of the at least two angular dispositions so that the angular disposition of the lower transparent panel may be adjusted to and locked in one of the at least two angular dispositions from at least one of the first lateral side portion and the second lateral side portion of the lower transparent panel.

20. A multi-positionable folding food shield as defined by claim 19, wherein the locking assembly of the at least one of the first upper panel support assembly and the second upper panel support assembly includes:

an upper panel support bracket on which one of the first lateral side portion and the second lateral side portion of the upper transparent panel is mounted, the upper panel support bracket including a lateral side having a surface in which is formed a plurality of spaced apart recesses arranged in a circle;

a locking chamber barrel, the locking chamber barrel having a barrel body, a side wall and an end face which faces the lateral side surface of the upper panel support bracket in which is formed the plurality of recesses, the upper panel support bracket being rotatably mounted to the locking chamber barrel, the locking chamber barrel having a first bore formed in the end face thereof and extending in an axial direction into the barrel body, the first bore being situated to be in alignment with one of the plurality of spaced apart recesses formed in the surface of the lateral side of the upper panel support bracket, the locking chamber barrel further having a second bore formed in the side wall thereof and extending in a direction transverse to the direction in which the first bore extends and to meet the first bore, the second bore being in communication with the first bore;

a plunger mounted in the second, transverse bore, the plunger having an inner axial tip and an outer axial end disposed opposite the inner axial tip and operatively joined to the inner axial tip, the inner axial tip being movable between a first position in which the tip extends into the first bore where the second bore meets the first bore, and a second position in which the tip does not extend into the first bore, the outer axial end of the plunger being graspable by a user of the food shield to effect movement of the inner axial tip of the plunger between the first position and the second position; and at least one displaceable member situated within the first bore, the at least one displaceable member being reciprocatingly movable within the first bore between a first state in which the at least one displaceable member is operatively forced by the plunger to be at least partially received in one of the plurality of recesses formed in the surface of the lateral side of the upper panel support bracket when the inner axial tip of the plunger is in the first position, and a second state in which the at least one displaceable member is not operatively forced by the plunger to be at least partially received in one of the plurality of recesses formed in the surface of the lateral side of the upper panel support bracket when the inner axial tip of the plunger is in the second position.

21. A multi-positionable folding food shield as defined by claim 20, wherein the at least one displaceable member includes an inner member, an outer member and an intermediary spacer member interposed between the inner member and the outer member, the inner member, intermediary spacer member and the outer member being situated within the first bore of the locking chamber barrel, the inner member being positioned in the first bore of the locking chamber barrel distally relative to the end face of the locking chamber barrel, and the outer member being positioned in the first bore of the locking chamber barrel proximally relative to the end face of the locking chamber barrel;

wherein the inner axial tip of the plunger engages the inner member when the inner axial tip is in the first position and forces the inner member, the intermediary spacer member and the outer member to move outwardly within the first bore of the locking chamber barrel in a direction towards the end face of the locking chamber barrel such that the outer member is at least partially received by one of the plurality of recesses formed in the surface of the lateral side of the upper panel support bracket to prevent relative movement between the upper panel support bracket and the locking chamber barrel and to thereby lock the upper transparent panel in a desired angular disposition.

22. A multi-positionable folding food shield as defined by claim 21, wherein the inner member is in the form of a first ball bearing, the intermediary spacer member is in the form of a cylindrical rod, and the outer member is in the form of a second ball bearing.

23. A multi-positionable folding food shield as defined by claim 19, wherein at least one of the first upper panel support assembly and the second upper panel support assembly includes an upper panel support bracket on which one of the first lateral side portion and the second lateral side portion of the upper transparent panel is mounted, the upper panel support bracket having a lower portion, the lower portion including a lateral side wall and further including a transverse wall situated transversely to the lateral side wall of the lower portion of the upper panel support bracket;

wherein the locking assembly of the at least one of the first lower panel support assembly and the second lower panel support assembly includes:

a lower panel support bracket on which one of the first lateral side portion and the second lateral side portion of the lower transparent panel is mounted, the lower panel support bracket including a lateral side wall in which is formed at least two spaced apart recesses, the lower panel support bracket having an upper portion;

wherein the upper portion of the lower panel support bracket is rotatably mounted on the lower portion of the upper panel support bracket;

wherein the lateral side wall of the lower portion of the upper panel support bracket faces the lateral side wall of the lower panel support bracket in which is formed the at least two spaced apart recesses;

wherein a first bore is formed in the lateral side wall of the lower portion of the upper panel support bracket and extending in a lateral direction into the lower portion of the upper panel support bracket, the first bore being situated to be in alignment with one of the at least two spaced apart recesses formed in the lateral side wall of the lower panel support bracket, the lower portion of the upper panel support bracket further having a second bore formed in the transverse wall thereof and extending in a direction transverse to the direction in which the first bore extends and to meet the second bore, the second bore being in communication with the first bore;

a plunger mounted in the second, transverse bore, the plunger having an inner axial tip and an outer axial end disposed opposite the inner axial tip and operatively joined to the inner axial tip, the inner axial tip of the plunger being movable between a first position in which the tip extends into the first bore where the second bore meets the first bore, and a second position in which the tip does not extend into the first bore, the outer axial end of the plunger being graspable by a user of the food shield to effect movement of the inner axial tip of the plunger between the first position and the second position; and at least one displaceable member situated within the first bore, the at least one displaceable member being reciprocatingly movable within the first bore between a first state in which the at least one displaceable member is operatively forced by the plunger to be at least partially received in one of the at least two recesses formed in the lateral side wall of the lower panel support bracket when the inner actual tip of the plunger is in the first position, and a second state in which the at least one displaceable member is not operatively forced by the plunger to be at least partially received in one of the at least two recesses formed in the lateral side wall of the lower panel support bracket when the inner axial tip of the plunger is in the second position.

24. A multi-positionable folding food shield as defined by claim 23, wherein the at least one displaceable member includes an inner member, an outer member and an intermediary spacer member interposed between the inner member and the outer member, the inner member, intermediary spacer member and the outer member being situated within the first bore formed in the lateral side wall of the lower portion of the upper panel support bracket, the inner member being positioned in the first bore of the upper panel support bracket distally relative to the lateral side wall of the lower portion of the upper panel support bracket, and the outer member being positioned in the first bore of the upper panel support bracket proximally relative to the lateral side wall of the lower portion of the upper panel support bracket;

wherein the inner axial tip of the plunger engages the inner member when the inner axial tip is in the first position and forces the inner member, the intermediary spacer member and the outer member to move outwardly within the first bore of the lower portion of the upper panel support bracket in a direction towards the lateral side wall of the lower portion of the upper panel support bracket such that the outer member is at least partially received by one of the at least two spaced apart recesses formed in the lateral side wall of the lower panel support bracket to prevent relative movement between the upper panel support bracket of the at least one of the first upper panel support assembly and the second upper panel support assembly and the lower panel support bracket of the locking assembly of the at least one of the first lower panel support assembly and the second lower panel support assembly and to thereby lock the lower transparent panel in a desired angular disposition.

25. A multi-positionable folding food shield as defined by claim 24, wherein the inner member of the at least one displaceable member is in the form of a first ball bearing, the intermediary spacer member of the at least one displaceable member is in the form of a cylindrical rod, and the outer member of the at least one displaceable member is in the form of a second ball bearing.

26. A multi-positionable folding food shield as defined by claim 19, wherein the locking assembly of the at least one of the first upper panel support assembly and the second upper panel support assembly includes:

an upper panel support bracket on which one of the first lateral side portion and the second lateral side portion of the upper transparent panel is mounted, the upper panel support bracket including a lateral side having a surface and a side wall extending transversely to the lateral side, the lateral side having a first bore formed in the surface thereof and extending in an lateral direction into the upper panel support bracket, the upper panel support bracket further having a second bore formed in the side wall thereof and extending in a direction transverse to the direction in which the first bore extends and to meet the first bore, the second bore being in communication with the first bore;

a locking chamber barrel, the locking chamber barrel having a barrel body and an end face which faces the lateral side surface of the upper panel support bracket, the end face having a plurality of spaced apart recesses formed therein and arranged in a circle, the first bore of the upper panel support bracket being situated to be in alignment with one of the plurality of spaced apart recesses formed in the end face of the locking chamber barrel, the upper panel support bracket being rotatably mounted to the locking chamber barrel;

a plunger mounted in the second, transverse bore, the plunger having an inner axial tip and an outer axial end disposed opposite the inner axial tip and operatively joined to the inner axial tip, the inner axial tip being movable between a first position in which the tip extends into the first bore where the second bore meets the first bore, and a second position in which the tip does not extend into the first bore, the outer axial end of the plunger being graspable by a user of the food shield to effect movement of the inner axial tip of the plunger between the first position and the second position; and at least one displaceable member situated within the first bore, the at least one displaceable member being reciprocatingly movable within the first bore between a first state in which the at least one displaceable member is operatively forced by the plunger to be at least partially received in one of the plurality of recesses formed in the end face of the locking chamber barrel when the inner axial tip of the plunger is in the first position, and a second state in which the at least one displaceable member is not operatively forced by the plunger to be at least partially received in one of the plurality of recesses formed in the end face of the locking chamber barrel when the inner axial tip of the plunger is in the second position.

27. A multi-positionable folding food shield as defined by claim 19, wherein at least one of the first upper panel support assembly and the second upper panel support assembly includes an upper panel support bracket on which one of the first lateral side portion and the second lateral side portion of the upper transparent panel is mounted, the upper panel support bracket having a lower portion, the lower portion including a lateral side wall;

wherein the locking assembly of the at least one of the first lower panel support assembly and the second lower panel support assembly includes:

a lower panel support bracket on which one of the first lateral side portion and the second lateral side portion of the lower transparent panel is mounted, the lower panel support bracket including an upper portion having a lateral side wall and a transverse wall situated transversely to the lateral side wall of the upper portion of the lower panel support bracket;

wherein the upper portion of the lower panel support bracket is rotatably mounted on the lower portion of the upper panel support bracket;

wherein the lateral side wall of the lower portion of the upper panel support bracket faces the lateral side wall of the upper portion of the lower panel support bracket;

wherein the lateral side wall of the lower portion of the upper panel support bracket has formed therein at least two spaced apart recesses;

wherein a first bore is formed in the lateral side wall of the upper portion of the lower panel support bracket and extending in a lateral direction into the upper portion of the lower panel support bracket, the first bore being situated to be in alignment with one of the at least two spaced apart recesses formed in the lateral side wall of the lower portion of the upper panel support bracket, the upper portion of the lower panel support bracket further having a second bore formed in the transverse wall thereof and extending in a direction transverse to the direction in which the first bore extends and to meet the second bore, the second bore being in communication with the first bore;

a plunger mounted in the second, transverse bore, the plunger having an inner axial tip and an outer axial end disposed opposite the inner axial tip and operatively joined to the inner axial tip, the inner axial tip of the plunger being movable between a first position in which the tip extends into the first bore where the second bore meets the first bore, and a second position in which the tip does not extend into the first bore, the outer axial end of the plunger being graspable by a user of the food shield to effect movement of the inner axial tip of the plunger between the first position and the second position; and at least one displaceable member situated within the first bore, the at least one displaceable member being reciprocatingly movable within the first bore between a first state in which the at least one displaceable member is operatively forced by the plunger to be at least partially received in one of the at least two recesses formed in the lateral side wall of the upper panel support bracket when the inner actual tip of the plunger is in the first position, and a second state in which the at least one displaceable member is not operatively forced by the plunger to be at least partially received in one of the at least two recesses formed in the lateral side wall of the upper panel support bracket when the inner axial tip of the plunger is in the second position.

* * * * *